US008540217B2

(12) United States Patent
Olsson et al.

(10) Patent No.: US 8,540,217 B2
(45) Date of Patent: Sep. 24, 2013

(54) FENCE POST ASSEMBLIES

(76) Inventors: Ashley Dean Olsson, Goulburn (AU); Ashley Norman Olsson, Goulburn (AU); Nathanael Dean Olsson, Goulburn (AU); Stafford James Olsson, Goulburn (AU); Kieran Blake Olsson, Goulburn (AU)

( * ) Notice: Subject to any disclaimer, the term of this patent is extended or adjusted under 35 U.S.C. 154(b) by 0 days.

(21) Appl. No.: 12/636,491

(22) Filed: Dec. 11, 2009

(65) Prior Publication Data

US 2010/0200826 A1 Aug. 12, 2010

Related U.S. Application Data

(63) Continuation-in-part of application No. PCT/AU2008/000857, filed on Jun. 13, 2008.

(30) Foreign Application Priority Data

Dec. 12, 2008 (AU) ..... 2008906403

(51) Int. Cl.
*B21F 29/00* (2006.01)
*E04H 17/12* (2006.01)

(52) U.S. Cl.
USPC ..... 256/48; 256/52

(58) Field of Classification Search
USPC ..... 256/45, 47–50, 52, 10; 24/457, 24/458
See application file for complete search history.

(56) References Cited

U.S. PATENT DOCUMENTS

| | | | | | |
|---|---|---|---|---|---|
| 338,818 | A | | 3/1886 | Barid | |
| 622,345 | A | * | 4/1899 | Greig et al. | 256/48 |
| 733,906 | A | * | 7/1903 | Froggatt | 256/49 |
| 757,989 | A | * | 4/1904 | Wix | 256/48 |
| 759,838 | A | | 5/1904 | Willmarth | |
| 796,313 | A | * | 8/1905 | Gannaway | 256/48 |
| 836,281 | A | * | 11/1906 | Senn | 256/48 |
| 851,445 | A | * | 4/1907 | Seymour | 256/48 |
| 890,468 | A | * | 6/1908 | Sutherland | 256/48 |
| 1,022,314 | A | * | 4/1912 | Golden | 256/48 |

(Continued)

FOREIGN PATENT DOCUMENTS

| | | |
|---|---|---|
| AU | 198781163 | 5/1988 |
| AU | 199184798 | 4/1992 |

(Continued)

OTHER PUBLICATIONS

Galvanised Steel C-Post Product Description. http://dmplastics.com.au/html/cposis.htm, Aug. 7, 2008.

(Continued)

*Primary Examiner* — Joshua Kennedy
(74) *Attorney, Agent, or Firm* — Byrne Poh LLP

(57) ABSTRACT

A fence post assembly (120) comprising a fence post (121) and at least one keeper (122) for holding a fencing wire (2) relative to the post (121). The keeper (122) is movable between a holding position in which the wire (2) is held relative to the post (121) and a release position in which the wire (2) may be released from the post (121). The keeper (121) comprises a slot (123) extending within the post (121) for receiving the wire (2) and a retainer (124) connected to the post (121) that is pivotable between the holding and release positions, wherein in the holding position the retainer (124) obstructs the slot (123).

32 Claims, 28 Drawing Sheets

(56) References Cited

U.S. PATENT DOCUMENTS

| | | | | | |
|---|---|---|---|---|---|
| 1,028,962 | A | | 6/1912 | Post | |
| 1,050,589 | A | * | 1/1913 | Young | 256/48 |
| 1,065,471 | A | * | 6/1913 | Rohe | 256/48 |
| 1,213,201 | A | * | 1/1917 | Hutchinson | 256/48 |
| 1,288,572 | A | | 12/1918 | Hanson | |
| 1,479,291 | A | | 1/1924 | Evans | |
| 1,565,707 | A | * | 12/1925 | Brown | 256/48 |
| 1,689,610 | A | * | 10/1928 | Winter | 256/48 |
| 1,736,707 | A | * | 11/1929 | Lake | 256/48 |
| 1,776,887 | A | * | 9/1930 | Christensen | 256/47 |
| 1,796,383 | A | * | 3/1931 | Mason | 256/49 |
| 2,221,477 | A | | 11/1940 | Gustafson | |
| 2,291,430 | A | | 7/1942 | Ingersoll | |
| 2,429,857 | A | * | 10/1947 | Verner | 174/161 F |
| 2,618,685 | A | * | 11/1952 | Lewis | 174/161 F |
| 2,861,122 | A | | 11/1958 | Flower | |
| 2,899,175 | A | * | 8/1959 | Culver et al. | 256/48 |
| 3,457,358 | A | * | 7/1969 | Brumfield | 174/45 R |
| 3,606,259 | A | * | 9/1971 | Farrell | 256/48 |
| 3,746,827 | A | | 7/1973 | Martin et al. | |
| 3,776,522 | A | * | 12/1973 | Bartlett | 256/47 |
| 3,801,731 | A | | 4/1974 | Hansen | |
| 3,908,964 | A | * | 9/1975 | Leiblich | 256/10 |
| 3,913,889 | A | | 10/1975 | Nugent et al. | |
| 4,134,575 | A | * | 1/1979 | Chavarria | 256/35 |
| 4,165,864 | A | | 8/1979 | Wright | |
| 4,290,712 | A | * | 9/1981 | Hayes | 404/10 |
| 4,346,871 | A | * | 8/1982 | Mauduit | 256/10 |
| 5,350,155 | A | | 9/1994 | Burk | |
| 5,860,636 | A | | 1/1999 | Duncan et al. | |
| 5,920,036 | A | | 7/1999 | Egger | |
| 5,975,501 | A | * | 11/1999 | Berg et al. | 256/48 |
| 6,276,182 | B1 | | 8/2001 | Cernuschi et al. | |
| 6,330,998 | B1 | | 12/2001 | Roy | |
| 6,612,551 | B1 | | 9/2003 | Roy | |
| 6,872,892 | B1 | * | 3/2005 | Burdick | 174/158 F |
| 2002/0038865 | A1 | | 4/2002 | Spyrakis | |
| 2004/0026678 | A1 | | 2/2004 | Vandergriff | |
| 2005/0061924 | A1 | | 3/2005 | Boyle | |
| 2005/0167644 | A1 | | 8/2005 | Deupree | |
| 2009/0246738 | A1 | | 10/2009 | Karmaker | |

FOREIGN PATENT DOCUMENTS

| | | | |
|---|---|---|---|
| AU | 5077693 | | 6/1994 |
| AU | 704590 | | 7/1998 |
| AU | 7619998 | | 1/1999 |
| AU | 9138098 | | 5/1999 |
| AU | 199943420 | | 3/2000 |
| AU | 2005201414 | | 12/2005 |
| AU | 2008100898 | | 10/2008 |
| AU | 322572 | | 12/2008 |
| CA | 2137335 | | 6/1996 |
| DE | 4009230 | | 5/1991 |
| FR | 420690 | A | 2/1911 |
| FR | 2428124 | | 1/1980 |
| FR | 2573617 | A1 | 5/1986 |
| GB | 191400512 | A | 1/1915 |
| GB | 1233119 | A | 5/1971 |
| GB | 2252991 | A | 8/1992 |
| GB | 2286839 | | 8/1995 |
| JP | 200328713 | | 11/2000 |
| WO | WO-03029583 | | 4/2003 |
| WO | WO2008154677 | | 12/2008 |

OTHER PUBLICATIONS

Th ePolylockTM Stock Fence System (designed by farmers for farmers), http://www.dmplastics.com.au/html/polylok.htm. Aug. 7, 2008.

International Search Report and Written Opinion of the International Searching Authority, International Patent Application No. PCT/AU2009/001316, Dec. 21, 2009.

English Translation of Japanese Patent Publication JP 2000-328713 to Kawasaki Steel Co., Nov. 28, 2000.

Examination Report from Australian Patent Application No. 2009248435, filed Dec. 10, 2009, mailed May 2, 2012.

International Patent Application No. PCT/AU2010/001456, filed Nov. 2, 2010.

International Patent Application No. PCT/AU2008/000856, filed Jun. 13, 2008.

International Patent Application No. PCT/AU2008/000857, filed Jun. 13, 2008.

International Patent Application No. PCT/AU2009/001316, filed Oct. 2, 2009.

International Patent Application No. PCT/AU2012/000727, filed 2012.

International Preliminary Report on Patentability in International Patent Application No. PCT/AU2008/000856, filed Jun. 13, 2008, issued Dec. 22, 2009.

International Preliminary Report on Patentability in International Patent Application No. PCT/AU2008/000857, filed Jun. 13, 2008, issued Dec. 22, 2009.

International Preliminary Report on Patentability in International Patent Application No. PCT/AU2009/001316, filed Oct. 2, 2009, issued Apr. 5, 2011.

International Preliminary Report on Patentability in International Patent Application No. PCT/AU2010/001456, filed Nov. 2, 2010, issued May 8, 2012.

International Search Report in International Patent Application No. PCT/AU2008/000856, filed Jun. 13, 2008, mailed Jul. 28, 2008.

International Search Report in International Patent Application No. PCT/AU2008/000857, filed Jun. 13, 2008, mailed Jul. 28, 2008.

International Search Report in International Patent Application No. PCT/AU2010/001456, filed Nov. 2, 2010, mailed Jan. 7, 2011.

U.S. Appl. No. 13/505,736, filed Jul. 17, 2012.

Written Opinion in International Patent Application No. PCT/AU2008/000856, filed Jun. 13, 2008, mailed Jul. 28, 2008.

Written Opinion in International Patent Application No. PCT/AU2008/000857, filed Jun. 13, 2008, mailed Jul. 28, 2008.

Written Opinion in International Patent Application No. PCT/AU2010/001456, filed Nov. 2, 2010, mailed Jan. 7, 2011.

* cited by examiner

FENCE POST ASSEMBLIES

CROSS REFERENCE TO RELATED APPLICATIONS

This application claims the benefit of Australian provisional patent application. No. 2008906403, filed Dec. 12, 2008 (which is hereby incorporated by reference herein in its entirety), and is a continuation-in-part of international application No. PCT/AU2008/000857, filed Jun. 13, 2008 (which is hereby incorporated by reference herein in its entirety), which designates the United States and which claims priority from Australian provisional patent applications Nos. 2007903261, filed Jun. 18, 2007, 2008900150, filed Jan. 12, 2008, and 2008901545, filed Mar. 31, 2008, (each of which is hereby incorporated by reference herein in its entirety).

TECHNICAL FIELD

This invention relates, inter alia, to a fence post assembly having a keeper for holding a fencing member (such as a wire or mesh panel) relative to a fence post. In one embodiment, the keeper is movable between a holding position in which the fencing member is held relative to the fence post and a release position in which the fencing member may be released from the fence post. This invention also relates to a method for constructing a fence.

BACKGROUND

In order to construct a wire fence, typically a fencer will first anchor fence posts to the ground at regular intervals. The fencer will then thread plain fencing wires through holes in the posts (if Y- or T-shape pickets) or otherwise attach the wires to the posts, then strain those wires, and then finally tie them off. In order to construct a mesh panel fence, typically the fencer will further tie a mesh panel to the strained plain wires, strain those panels, and then finally tie them off.

Disadvantages of the above described method include that it is tedious and time-consuming. In particular, the fencer is required to thread wires through numerous holes, and several trips along a length of the fence may be required in order to do this and to fully strain the fence.

Other disadvantages include that additional fence posts cannot be readily added to the existing fence and damaged fence posts cannot be replaced without first releasing the wires—following which the wires would again require re-threading and straining.

Yet another disadvantage is that such a fence cannot be readily disassembled for relocation or recycling purposes.

SUMMARY

In accordance with some embodiments, fence post assemblies, methods of constructing a fence, and retainers for holding a fence member within a slot of a post are provided.

According to a first aspect of some embodiments, there is provided a fence post assembly comprising: a fence post; and at least one keeper for holding a fencing member relative to the post, wherein the keeper is movable between a holding position in which the member is held relative to the post and a release position in which the member may be released from the post.

The post may be of any suitable size, shape and construction, and may be made of any suitable material or materials. The post may be, for example, a pipe, a beam, a stake or a picket, it may be made of galvanised metal, plastics material or of wood. Preferably, the post is a Y-shape picket or a T-shape picket made of coated steel.

The post may be a composite/hybrid of different materials. For instance, the post may comprise a longitudinal metallic portion and a non-metallic portion extending longitudinally along the metallic portion, wherein the non-metallic portion has a plurality of keepers spaced along a length of the non-metallic portion. The longitudinal metallic and non-metallic portions may be connected to one another in any suitable way, e.g. fasteners such as nuts and bolts, adhesive or a melt weld.

The keeper may be connected to, connectable to, provided by or formed within the longitudinal non-metallic portion. Preferably, the post comprises a metallic support and a plastic strip extending longitudinally along the metallic support, wherein the plastic strip has a plurality of keepers spaced along a length of the strip. The plastic strip may be connected to the longitudinal metallic support with nuts and bolts.

The keeper may be of any suitable size, shape and construction, and may be made of any suitable material or materials.

In a first embodiment of the invention, the keeper comprises a resilient retainer extending from the post and having a fencing member receiving end abutting (or almost abutting) the post. The receiving end may be movable between the holding and release positions. In the holding position the receiving end may abut (or almost abut) the post and in the release position the receiving end may be spaced from the post so as to be able to accept the fencing member.

In a second embodiment of the invention, the keeper may comprise an opening extending within the post for receiving the fencing member and at least one retainer connected to the post that is movable between the holding and release positions, wherein in the holding position the retainer retains the fencing member within the opening.

The opening may be of any suitable size and shape. Preferably, the opening is a slot extending within the post such that the fencing member, when held by the retainer, extends across the post relative to a length of the post. The slot may have an open end and a blind end. The slot may extend linearly or at different angles within the post. The slot may extend, for example, horizontally, vertically, angularly and/or curvedly within the post. The slot may have upper and/or lower grooves in which the retainer or a part of the retainer may locate when in either the holding or release position. The blind end may be tapered so as to "grab" the fencing member.

The retainer may be of any suitable size, shape and construction. The retainer may be connected to the post and movable relative thereto in any suitable way.

In one embodiment, the retainer may be slidable between the holding and release positions, e.g. by way of a tongue and groove arrangement.

In another embodiment, the retainer may have a flexible end obstructing movement of the fencing member through the slot, and the end may be movable between the holding and release positions, whereby in the release position the fencing member is free to exit through the open end of the slot. In this embodiment, the retainer may comprise spring steel.

In another embodiment, the retainer may be pivotally connected to the post and pivoted between the holding and release positions. In this embodiment, the retainer may have a post mounting region and a fencing member engaging region. The post mounting region may be mounted to the post by way of a pin of the retainer. The fencing member engaging region may extend across the slot so as to obstruct movement of the fencing member towards the open end of the slot when the retainer is in the holding position. The fencing member engaging region may be hook shaped so as to hook around the fencing member whilst the fencing member is located within the slot. The fencing member engaging region may extend within the post across the slot so as to obstruct movement of the fencing member towards the open end of the slot when the retainer is in the holding position. The fencing member engaging region may locate within the upper and lower grooves of the slot when in the release and holding positions, respectively.

The retainer may be biased to move to and remain in the holding position and this may be achieved in any suitable way. It may be biased, for example, by way of a spring or other type of biasing member, or by way of gravity. If by gravity, then the retainer may have a counter-balance region that causes the fencing member engaging region to pivot such that it extends across the slot so as to obstruct movement of the fencing member towards the open end of the slot.

The keeper may comprise more than one type of retainer for holding the fencing member within the slot.

The keeper may be connectable to the post. That is, the keeper may be connected to, say, a mount and the mount may be connectable to the post. This may be achieved in any suitable way. In one embodiment, the mount is in the form of a plastic strip having at least one said retainer and slot, and the strip is connectable to a longitudinal edge of the post by way of fasteners.

Any suitable type of fencing member may be held relative to the post. In one embodiment, the fencing member is a plain wire or a length of barbed wire. The post assembly may have a plurality of keepers spaced along a length of the post, so as to form a 2-8 strand high wire fence.

In another embodiment, the fencing member may be a mesh panel, in which case the post assembly may have a plurality of keepers spaced along a length of the post for holding different substantially horizontally extending strands of the mesh panel.

In yet another embodiment, the fencing member may be an insulator, a bracket, a rain gauge or other type of accessory that may usually be found connected to or otherwise associated with a fence. The fencing member may be an accessory that is not usually connected to or otherwise associated with a fence. Such a fencing member will have a keeper-engaging region (as described later in this specification) for being held by the keeper relative to the fence post.

The post assembly may be anchored or otherwise fastened to any suitable surface, such that the post extends vertically, horizontally or at any other desired angle. That is, the post could extend at any suitable angle from, say, a bridge or building. Preferably, the post is anchored to a ground surface by way of being partially driven into the ground.

According to a second aspect of some embodiments, there is provided a method of constructing a fence, said method comprising: anchoring at least one fence post assembly to a surface, wherein the post assembly comprises a fence post and at least one keeper for holding a fencing member relative to the post, wherein the keeper is movable between a holding position in which the member is held relative to the post and a release position in which the member may be released from the post; and engaging a fencing member with the keeper such that the keeper holds the fencing member relative to the post.

In some embodiments, the method additionally comprises straining (tensioning) the fencing member once, or before, it is held relative to the post.

The fence post assembly and fencing member may be as described in respect of the first aspect of the invention.

According to a third aspect of some embodiments, there is provided a mesh panel when used as a fencing member for the fence post assembly according to the first aspect of the present invention, or when used in the method according to the second aspect of the present invention.

The mesh panel may be of any suitable size, shape and construction, and may be made of any suitable material or materials. The mesh panel may have rectangular, orthoganol or other shaped openings. Preferably, the mesh panel comprises a plurality of substantially horizontally and substantially vertically extending wires that are connected to one another. Preferably, each horizontally extending wire is held by a keeper of a fence post assembly.

According to a fourth aspect of some embodiments, there is provided a fencing member for use with the fence post assembly according to the first aspect of the present invention, or for use in the method according to the second aspect of the present invention.

The fencing member according to the fourth aspect of the present invention may comprise a keeper-engaging region for being held by the keeper relative to the fence post and at least one other region providing the desired functionality. Preferably, the fencing member comprises a support body, a pair of pin support arms extending laterally of the support body that straddles the post, and a locking pin extending between the pin support arms that is engagable with the keeper. An insulator ring or bracket, or a rain gauge may be supported by the support body. The fencing member may further comprise at least one pair of positioning arms extending laterally of the support body that straddles the post of the fence post assembly.

According to a fifth aspect of some embodiments, there is provided a fencing member comprising: a keeper-engaging region for engaging a keeper of a fence post assembly; and at least one other region providing a desired function, wherein said keeper is able to hold the fencing member relative to a post of the assembly, and the keeper is movable between a holding position in which the fencing member is held relative to the post and a release position in which the fencing member may be released from the post.

According to a sixth aspect of some embodiments, there is provided a retainer for holding a fencing member within a slot of a post, wherein the retainer is connectable or connected to the post and pivotable between a holding position in which the fencing member is held within the slot and a release position in which the fencing member is releasable from the slot, wherein the retainer is biased to automatically return from the release position to the holding position.

The retainer may be as described in other aspects of the present invention.

According to a seventh aspect of some embodiments, there is provided a fencing wire locator for use with the fence post assembly according to the first aspect of the present invention, or for use in the method according to the second aspect of the present invention, wherein the locator inserts fencing wires as a group or wires of a wire mesh panel into the slots of keepers of a fence post.

The locator may be of any suitable size, shape and construction. Preferably, the locator comprises an elongate body, one or more handles extending from one side of the body, and a row of wire-engaging teeth extending from another side of the body. In use, fencing wires are made to engage the teeth and the teeth are then moved by an installer relative to the post such that each wire engages it's respective keeper (one at a time).

Various embodiments of the invention will now be described by way of example with a reference to the accompanying figures.

DETAILED DESCRIPTION

Figure 1:
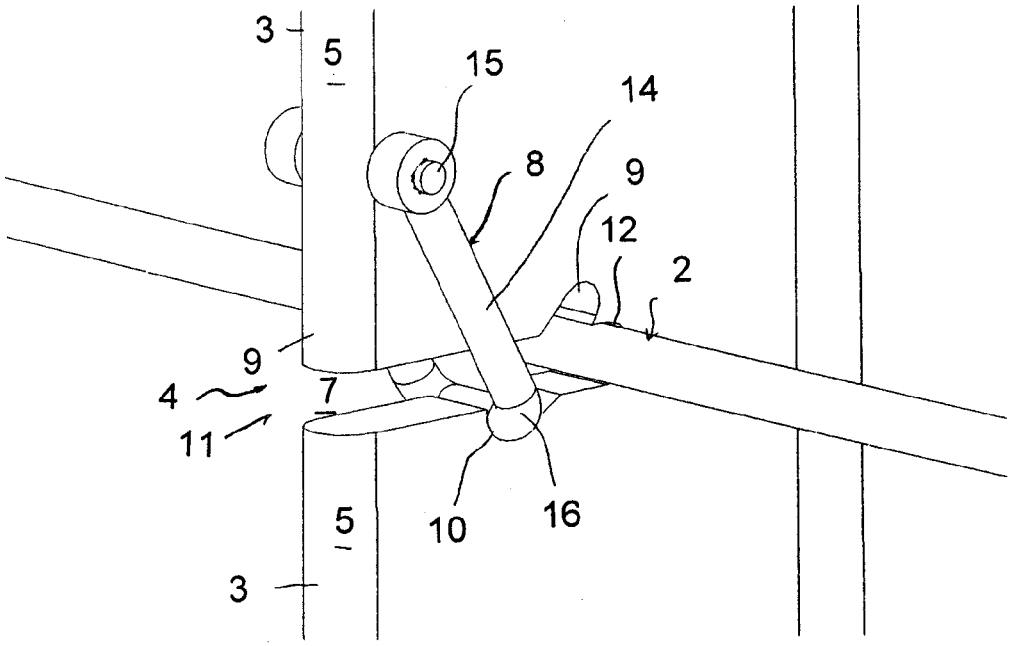
FIG. 1 is a side perspective view of part of a fence post assembly holding a fencing wire, according to an embodiment of the present invention.

In the figures, like reference numerals refer to like features.

Figure 2:
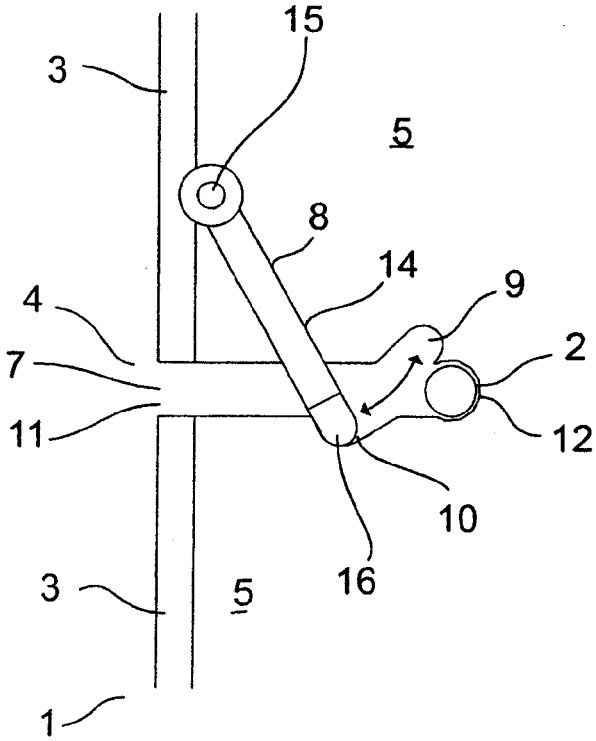
FIG. 2 is a side elevation view corresponding to FIG. 1.

Referring first to FIGS. 1 and 2, there is shown part of a fence post assembly 1 for holding a fencing member, such as a fencing wire 2. The post assembly 1 includes a post 3 and numerous keepers 4 (only one is shown) spaced along a length of the post 3. The post 3 that is shown is in the form of a coated steel Y-shape picket and part of an arm 5 of the post 3 is shown.

Each keeper 4 comprises a slot 7 extending within the arm 5 and a retainer 8 that is movable between a fencing member holding position (as shown in FIG. 2) and a fencing member release position. The slot 7 extends horizontally within the arm 5 and has an open end 11, a blind end 12, as well as upper 9 and lower 10 grooves (best seen in FIG. 2).

The retainer 8 is in the form of a D-shackle wherein a post mounting end 15 of the retainer 8 extends transversely through an aperture in the arm 5 and a fencing member engaging end 16 of the retainer 8 extends across the slot 7. Regions 14 of the retainer 8 that interconnect ends 15 and 16 extend along each side of the arm 5.

The retainer 8 can pivot between the fencing member 2 holding and release positions. When inserting a fencing wire 2 into the slot 7, the wire 2 pushes the fencing member engaging end 16 up into the upper groove 9. In order to release the wire 2 from the slot 7, the retainer 8 must first be pivoted upwardly by hand such that the fencing member engaging end 16 locates within the upper groove 9. In the fencing member holding position, the fencing member engaging end 16 locates within the lower groove 10. The lower groove 10 is there to provide a positive recess for retainer 8 to sit in, so that any pressure from the wire 2 (eg. when livestock push against the fence) will not result in the wire 2 being released from the slot 7 by accident.

Figure 3:
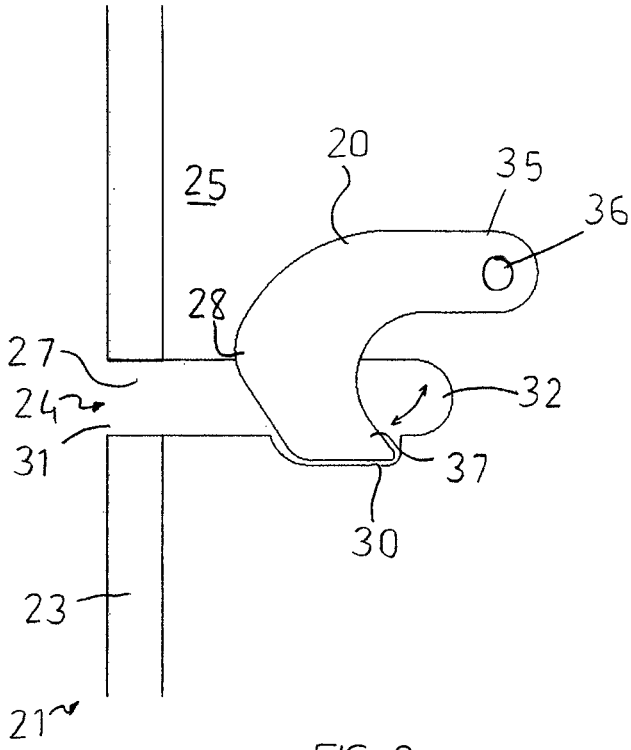
FIG. 3 is a side elevation view of part of a fence post assembly, according to an embodiment of the present invention.
Figure 4:
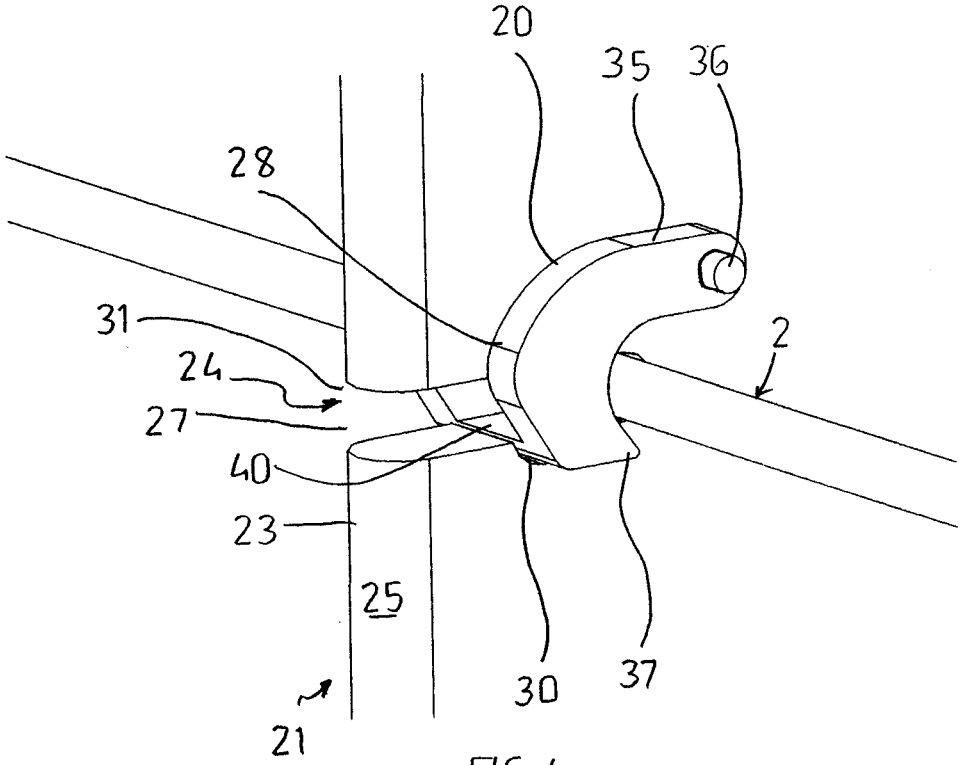
FIG. 4 is a side perspective view corresponding to FIG. 3 but holding a fencing wire.

Turning now to FIGS. 3 and 4, there is shown part of a fence post assembly 21 holding a fencing member (wire 2). The post assembly 21 includes a post 23 and numerous keepers 24 (only one is shown) spaced along a length of the post 23.

Each keeper 24 comprises a slot 27 extending within an arm 25 of the post 21, and a retainer 28 that is movable between a fencing member holding position (as shown in FIG. 4) and a fencing member release position. The slot 27 extends horizontally within the arm 25 and has an open end 31, a blind end 32, as well as a lower 30 groove, as seen in FIG. 3.

The retainer 28 is in the form of a pair of interconnected hooks 20 having a post mounting end 35 pinned to the post 21 with a pin 36, and a fencing member engaging end 37 having an interconnecting crosspiece 40 extending across the slot 27. The hooks 20 extend along each side of the arm 25.

The retainer 28 can pivot between the fencing member holding and release positions. Prior to inserting the wire 2 into the slot 27, the fencing member engaging end 37 of the retainer 28 is first pivoted out of the lower groove 30 by hand towards the blind end 32 (as indicated by the two-headed arrow of FIG. 3). The wire 2 is then moved beneath end 37 into the blind end 32 and the retainer 28 is then released such that end 37 locates within the groove 30.

In order to release the wire 2 from the slot 27, the retainer 28 must first be pivoted upwardly by hand such that the fencing member engaging end 37 moves out of the lower groove 30. The wire 2 is then pulled beneath end 37 and out of the slot 27.

Figure 5:
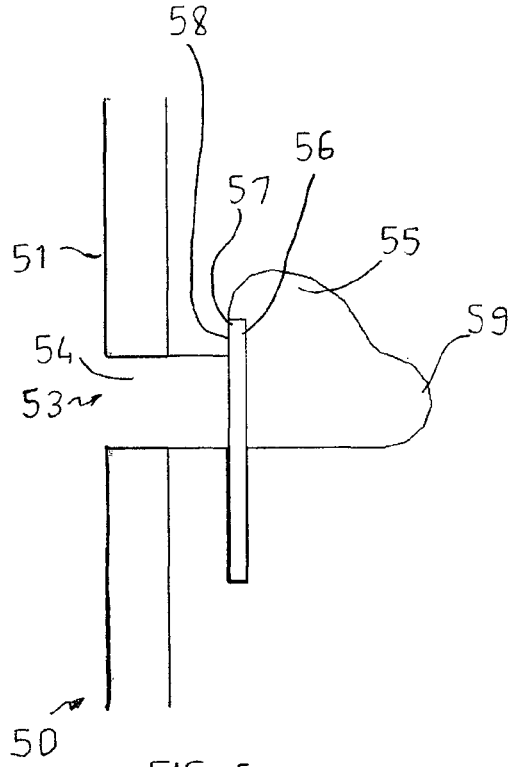
FIG. 5 is a side elevation view of part of a fence post assembly, according to an embodiment of the present invention.
Figure 6:
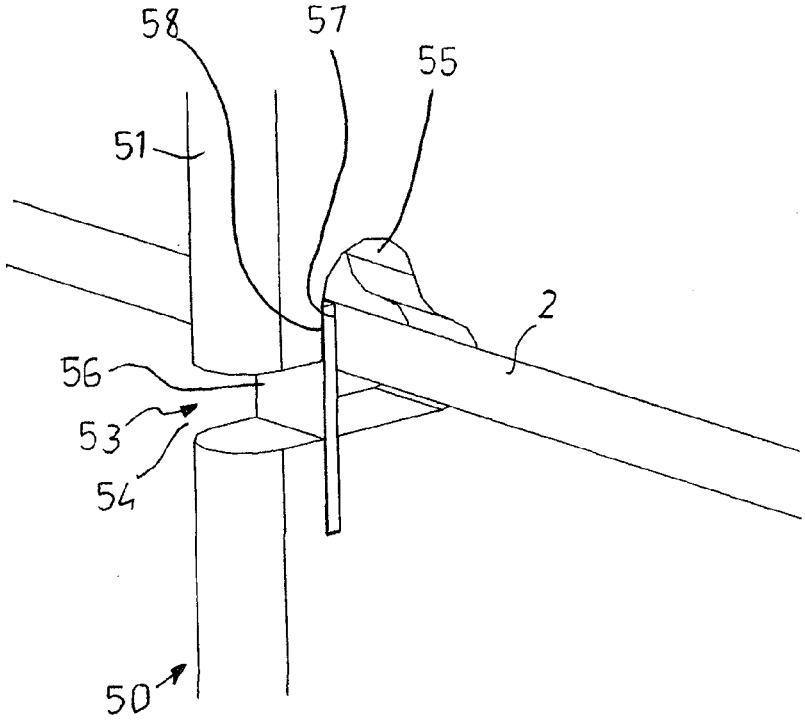
FIG. 6 is a side perspective view corresponding to FIG. 5 but holding a fencing wire.

Turning now to FIGS. 5 and 6, there is shown a fence post assembly 50 according to another embodiment of the invention. Again, a fence post 51 of the assembly 50 is in the form of a Y-shape picket.

A keeper 53 of the assembly 50 comprises a horizontally extending slot 54 having a blind end 59 and an upper groove 55, and a spring steel retainer 56 that extends across the slot 54. The retainer 56 has an upper end 57 located within the upper groove 55. A lower end of the retainer 56 is fixed to the post 51.

When inserting a wire 2 into the slot 54, the upper end 57 of the retainer 56 flexes from a fencing member holding position (as shown in FIG. 5) to a release position such that the wire 2 may be moved and trapped between the retainer 56 and the blind end 59 of the slot 54. Since the retainer 56 is made of spring steel, the upper end 57 of the retainer 56 springs back into abutment with an internal shoulder 58 of the post 51 after the wire 2 has passed between the upper end 57 and the shoulder 58. In order to release the wire 2, the upper end 57 must first be moved out of abutment with the shoulder 58 of the post 51.

Figure 7:
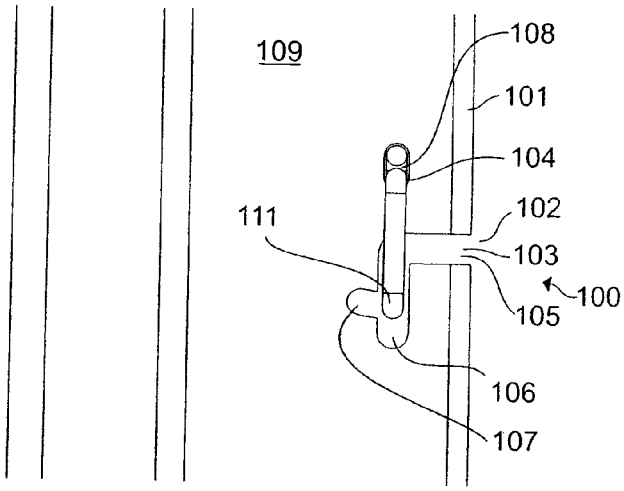
FIG. 7 is a side elevation view of part of a fence post assembly, according to an embodiment of the present invention.
Figure 8:
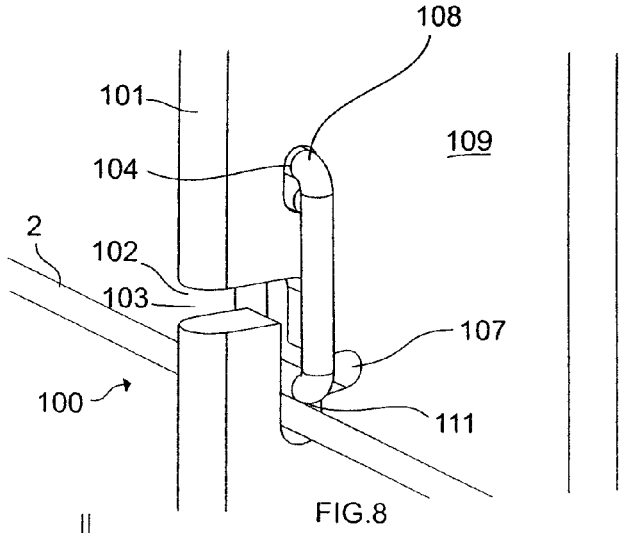
FIG. 8 is a side perspective view corresponding to FIG. 7 but holding a fencing wire.
Figure 9:
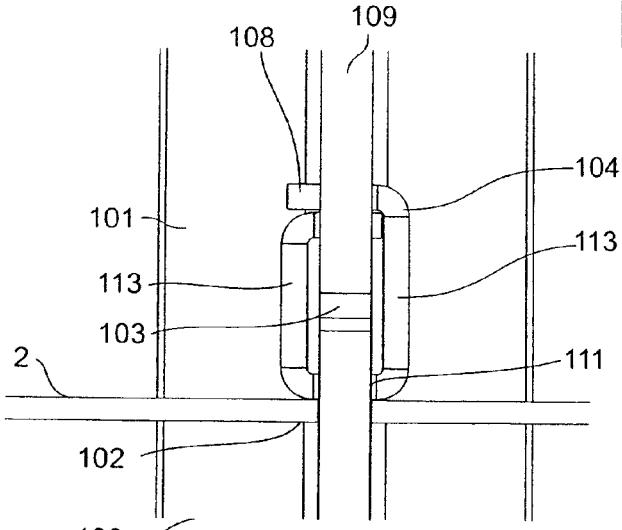
FIG. 9 is a front elevation view corresponding to FIG. 8.

Turning now to FIGS. 7-9, there is shown a fence post assembly 100 for holding a fencing member (eg. wire 2), according to another embodiment of the invention. A fence post 101 of the assembly 100 is in the form of a Y-shape picket.

A keeper 102 of the assembly 100 comprises a slot 103 and a retainer 104 that is movable between a fencing member holding position (as shown in FIG. 8) and a fencing member release position. As shown in FIG. 7, the slot 103 is L-shaped and has an open end 105, a blind end 106 and a lateral groove 107.

The retainer 104 is in the form of a spring steel link wherein a post mounting end 108 of the retainer 104 extends transversely through an aperture in an arm 109 of the post 101 and a fencing member engaging end 111 of the retainer 104 extends across the slot 103. As seen in FIG. 9, regions 113 of the retainer 104 that interconnect ends 108 and 111 extend along each side of the arm 109.

The retainer 104 can pivot between the fencing member holding and release positions. When inserting a wire 2 into the slot 103, the wire 2 pushes the fencing member engaging end 111 into the groove 107, at which time the wire 2 is movable into the blind end 106 of the slot 103. In the fencing member holding position, the fencing member engaging end 111 is positioned as shown in FIG. 8, so that any pressure from the wire 2 (eg. when livestock push against the fence) will not result in the wire 2 being released from the slot 103 by accident. In order to release the wire 2 from the slot 103, the retainer 104 must first be pivoted upwardly by hand such that the fencing member engaging end 111 locates within the lateral groove 107.

Turning now to FIGS. 10 to 15, there is shown a fence post assembly 120 according to another embodiment of the invention. A fence post 121 of the assembly 120 is in the form of a Y-shape picket. A keeper 122 of the assembly 120 comprises an L-shaped slot 123 and a retainer assembly. The retainer assembly comprises a retainer 124, a pivot pin 126 and a travel stop pin 135.

Figure 10:
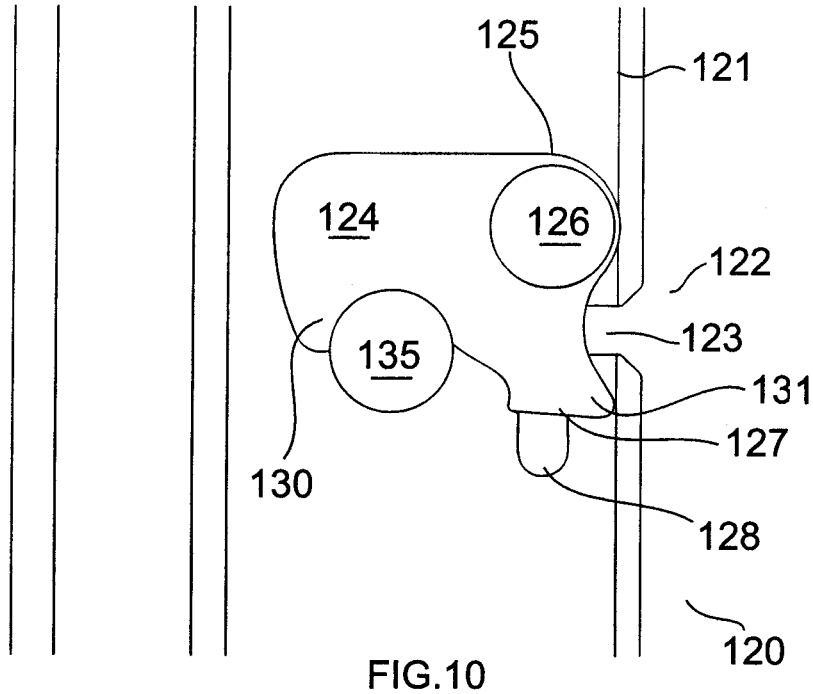
FIG. 10 is a side elevation view of part of a fence post assembly, according to an embodiment of the present invention.
Figure 11:
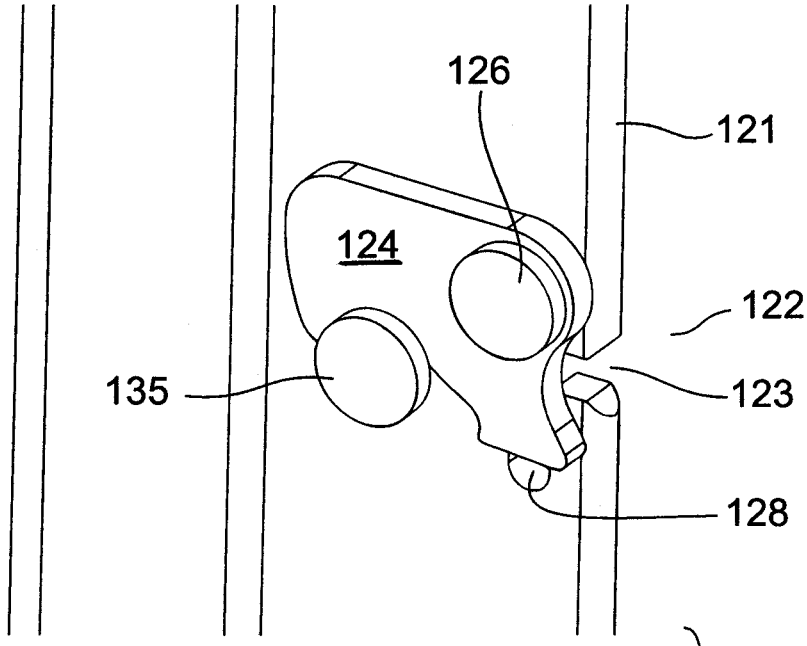
FIG. 11 is a side perspective view corresponding to FIG. 10.
Figure 12:
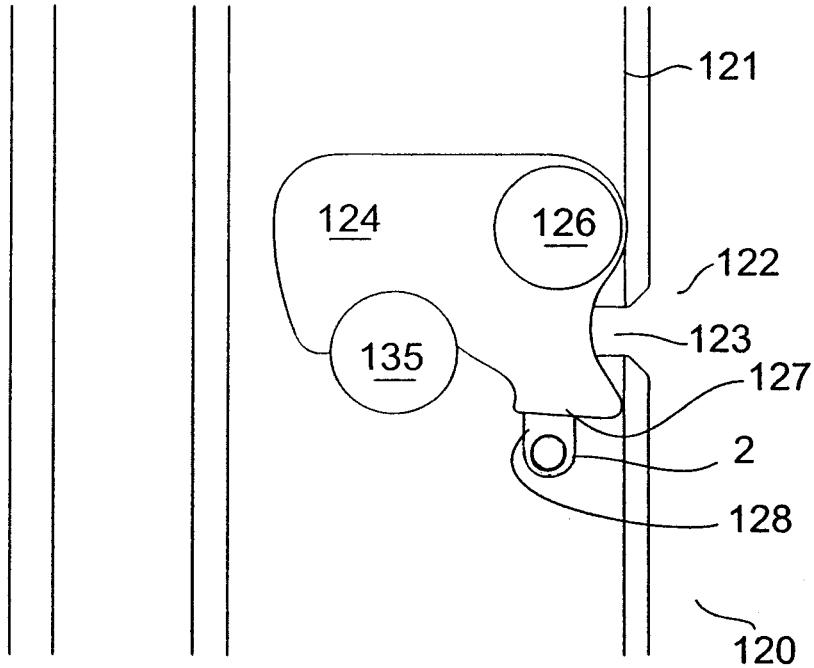
FIG. 12 is a side elevation view corresponding to FIG. 10 but holding a fencing wire.

The retainer 124 is pivotally mounted to a post 121 arm and can pivot between fencing member holding and release positions. As shown in FIG. 10, the retainer 124 comprises a post mounting region 125, a fencing member engaging region 127 and a counter-balance region 130. The travel stop pin 135 extends laterally of the fence post 121 arm between the fencing member engaging region 127 and the counter-balance region 130. The pivot pin 126 extends through the post 121 arm and mounting region 125, and enables the fencing member engaging region 127 to pivot relative to the post 121 arm. The fencing member engaging region 127 has a tapered nose 131 that is shaped to both allow a fencing member to locate within a blind end 128 of the slot 123 and to be retained within the blind end 128.

Figure 13:
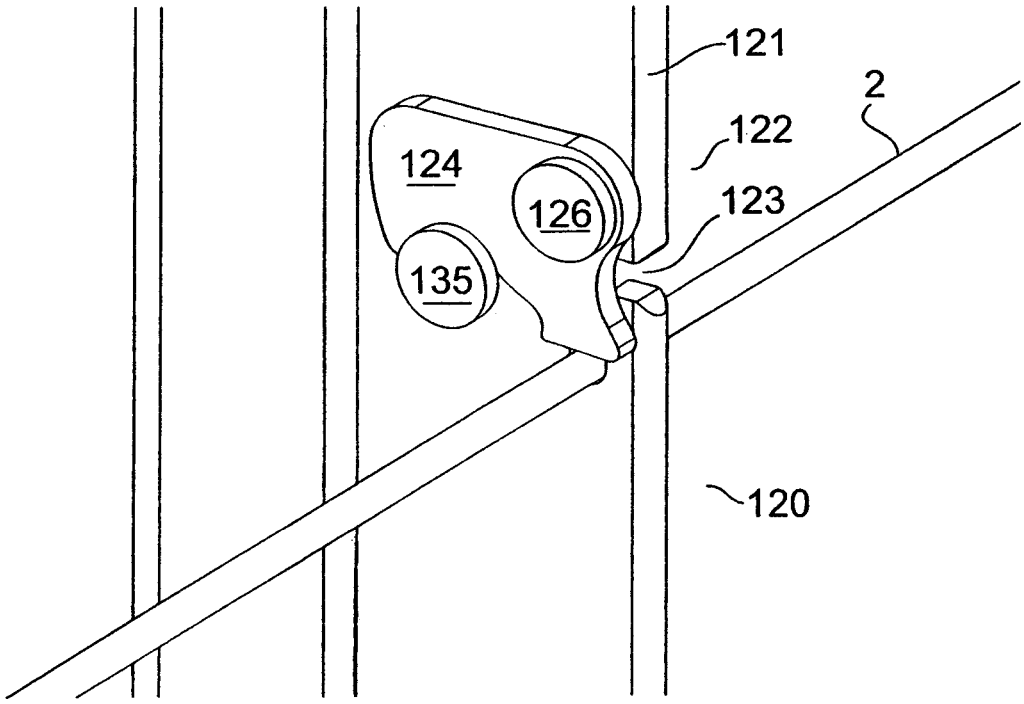
FIG. 13 is a side perspective view corresponding to FIG. 12.
Figure 14:
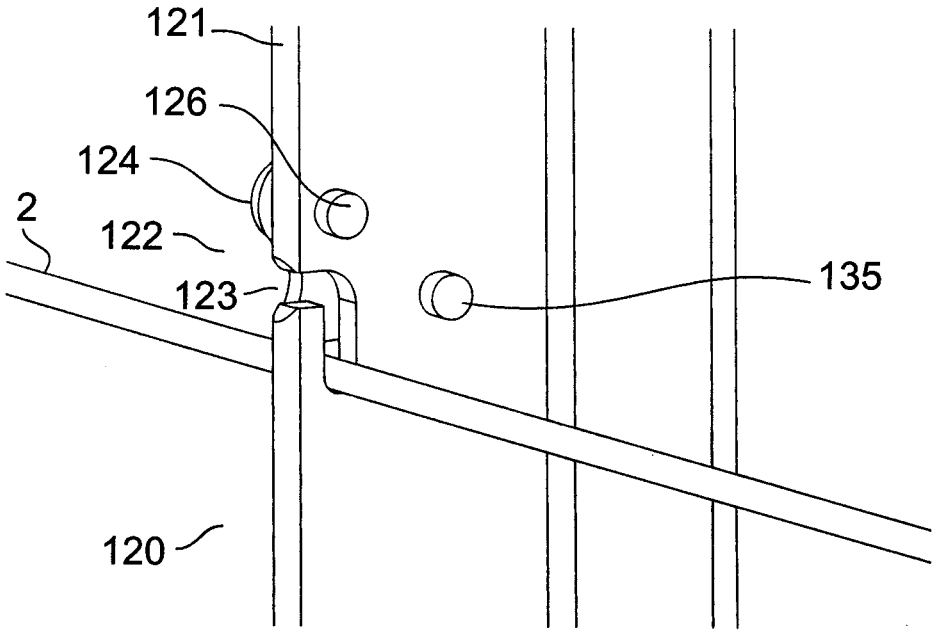
FIG. 14 is a reverse side perspective view corresponding to FIG. 13.
Figure 15:
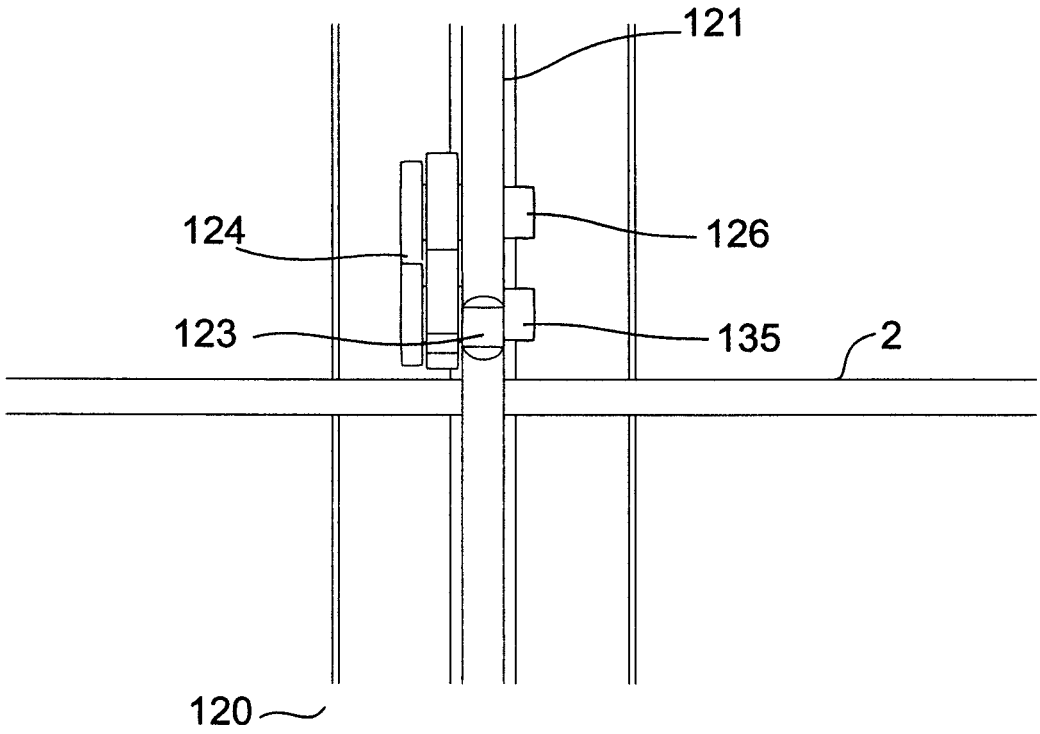
FIG. 15 is a front elevation view corresponding to FIG. 14.

FIGS. 13-15 shows the retainer 124 in the fencing member holding position. When inserting a fencing wire 2 into the slot 123, the fencing wire 2 engages the tapered nose 131 and pushes the fencing member engaging region 127 downwardly. The fencing wire 2 then locates within the blind end 128 of the slot 123, at which time the fencing member engaging region 127 pivots back to the holding position due to the weight of the counter-balance region 130. The travel stop pin 135 resists further downward movement of the counter-balance region 130 and ensures that the fencing wire 2 cannot disengage the slot 123 by accident. In order to release the fencing wire 2 from the slot 123, the fencing member engaging region 127 must be pivoted downwardly by hand, such that the fencing wire 2 can freely move to an open end of the slot 123.

Figure 16:
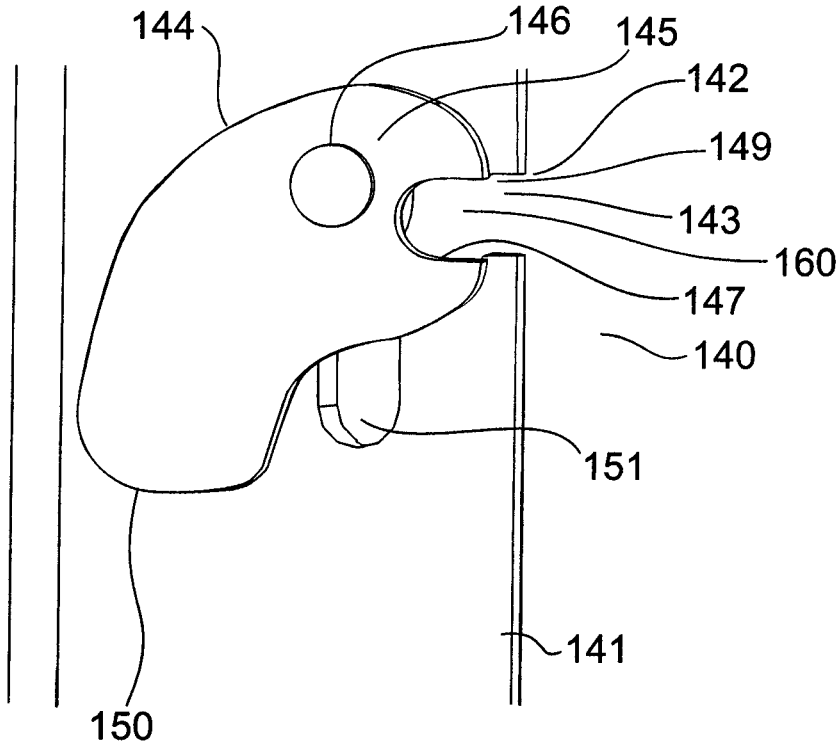
FIG. 16 is a side perspective view of part of a fence post assembly, according to an embodiment of the present invention.
Figure 17:
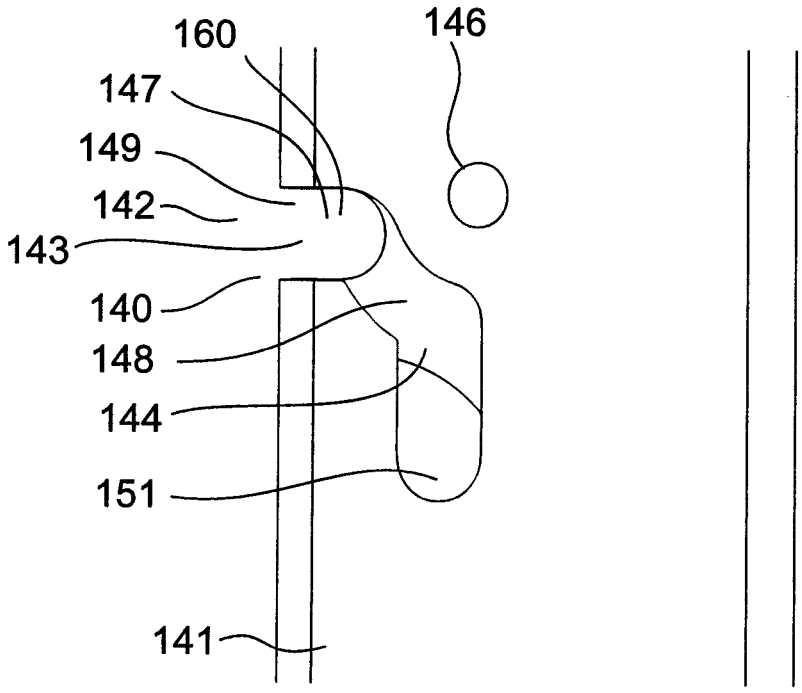
FIG. 17 is a reverse side perspective view corresponding to FIG. 16.

Turning now to FIGS. 16 and 17, there is shown a fence post assembly 140 according to another embodiment of the invention. A fence post 141 of the assembly 140 is in the form of a Y-shape picket. A keeper 142 of the assembly 140 comprises a slot 143 and a retainer assembly.

The slot 143 has an arcuate portion 148 flanked by linear portions 149, 151. Linear portion 149 corresponds to an open end 149 of the slot 143 whereas linear portion 151 corresponds to a blind end 151 of the slot 143.

The retainer assembly comprises a retainer 144 and a pivot pin 146. The retainer 144 is pivotally mounted to a post 141 arm by way of the pivot pin 146, and can pivot between fencing member holding and release positions. The retainer 144 comprises a post mounting region 145 through which the pivot pin 146 extends, a fencing member engaging region 147, and a counter-weight region 150. The fencing member engaging region 147 has a mouth 160 shaped to receive a fencing member and to guide movement of the member to the blind end 151 of the slot 143. As the retainer 144 pivots to the holding position, the mouth 160 coincides with the arcuate portion 148 of the slot 143.

FIG. 16 shows the retainer 144 in the fencing member holding position. When inserting a fencing member into the slot 143, the fencing member engages the mouth 160 and pushes the fencing member engaging region 147 downwardly. As the retainer 144 rotates relative to the post 141 arm, the mouth 160 aligns perfectly with the arcuate portion 148 of the slot 143. The fencing member then locates within the blind end 151 of the slot 143, at which time the fencing member engaging region 147 pivots back to the holding position due to the weight of the counter-balance region 150.

In order to release the fencing member from the slot 143, the fencing member engaging region 147 must be pivoted downwardly by hand, until such time that the fencing member can be received by the mouth 160 and guided to the open end 149 of the slot 143.

Figure 18:
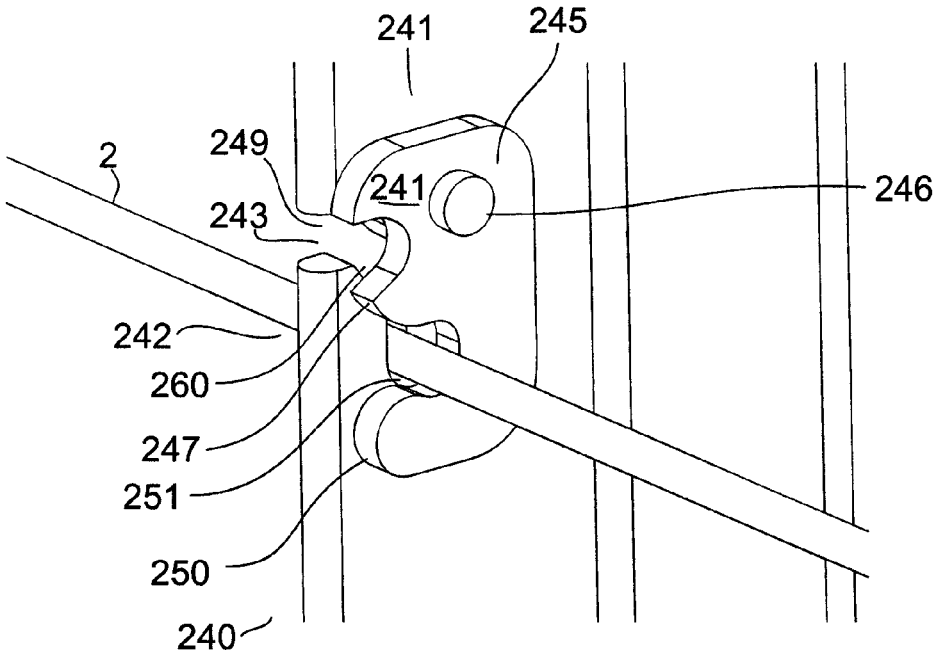
FIG. 18 is a side perspective view of part of a fence post assembly, holding a fencing wire, according to an embodiment of the present invention.
Figure 19:
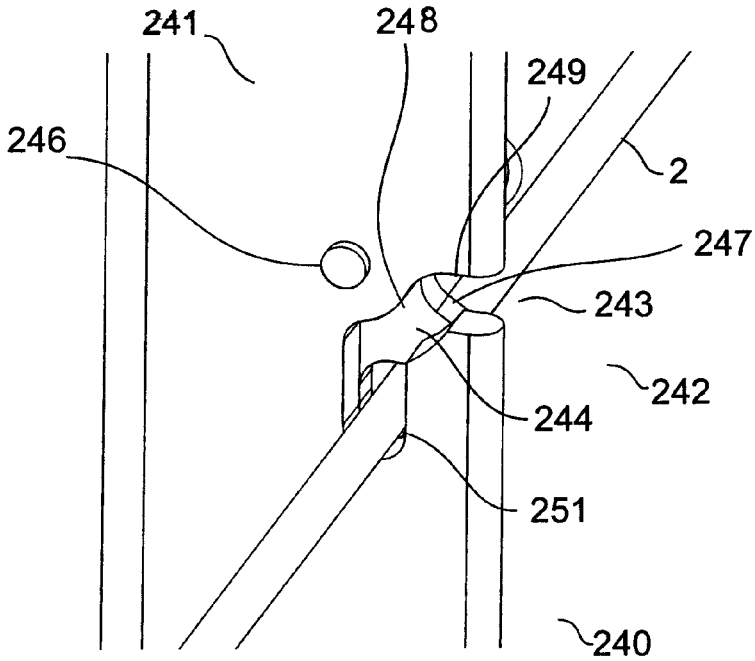
FIG. 19 is a reverse side perspective view corresponding to FIG. 18.
Figure 20:
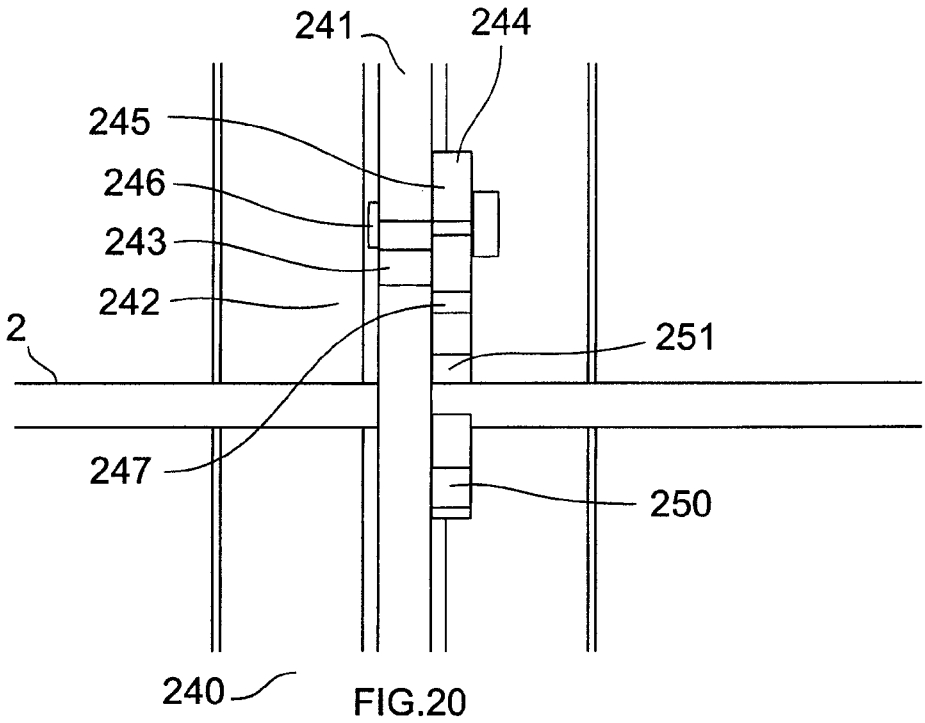
FIG. 20 is a front elevation view corresponding to FIG. 19.

Turning now to FIGS. 18-20, there is shown a fence post assembly 240 according to another embodiment of the invention. A fence post 241 of the assembly 240 is in the form of a Y-shape picket. A keeper 242 of the assembly 240 comprises a slot 243 and a retainer assembly.

The slot 243 has an arcuate portion 248 flanked by linear portions 249, 251, as seen in FIG. 19. Linear portion 249 corresponds to an open end 249 of the slot 243 whereas linear portion 251 corresponds to a blind end 251 of the slot 243.

The retainer assembly comprises a retainer 244 and a pivot pin 246. The retainer 244 is pivotally mounted to a post 241 arm by way of the pivot pin 246, and can pivot between fencing member holding and release positions. The retainer 244 comprises a mounting region 245 through which the pivot pin 246 extends, a fencing member engaging region 247, and a counter-weight region 250. The fencing member engaging region 247 has a mouth 260 shaped to receive a fencing member and to guide movement of the member to the blind end 251 of the slot 243. As the retainer 244 pivots to the holding position, the mouth 260 coincides with the arcuate portion 248 of the slot 243.

FIG. 18 shows the retainer 244 in the fencing member holding position. When inserting a fencing member, such as a wire 2, into the slot 243, the fencing member engages the mouth 260 and pushes the fencing member engaging region 247 downwardly. As the retainer 244 rotates relative to the post 241 arm, the mouth 260 aligns perfectly with the arcuate portion 248 of the slot 243. The fencing member wire 2 then locates within the blind end 251 of the slot 243, at which time the fencing member engaging region 247 pivots back to the holding position due to the weight of the counter-balance region 250.

In order to release the wire 2 from the slot 243, the fencing member engaging region 247 must be pivoted downwardly by hand, until such time that the wire 2 can be received by the mouth 260 and guided to the open end 249 of the slot 243.

Figure 21:
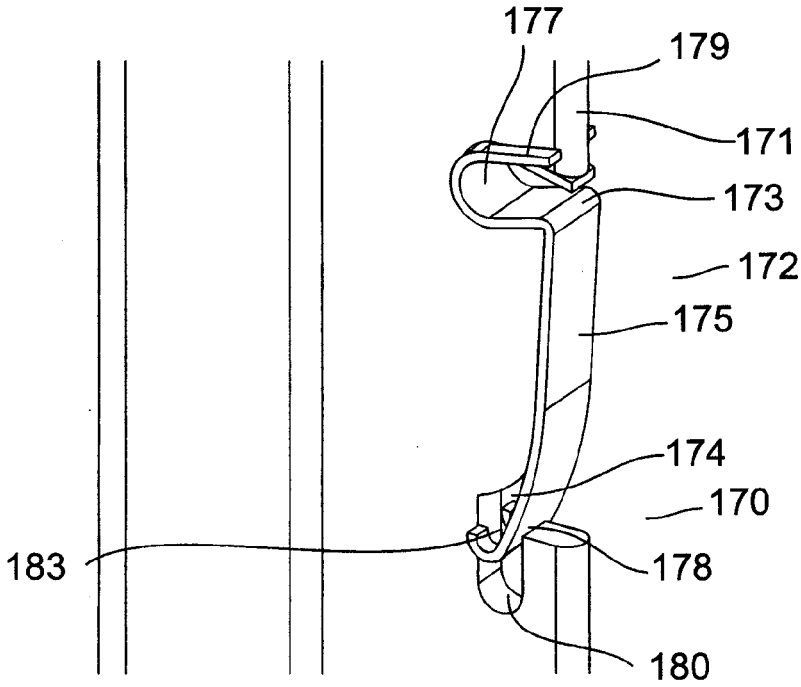
FIG. 21 is a side perspective view of part of a fence post assembly, according to an embodiment of the present invention.
Figure 22:
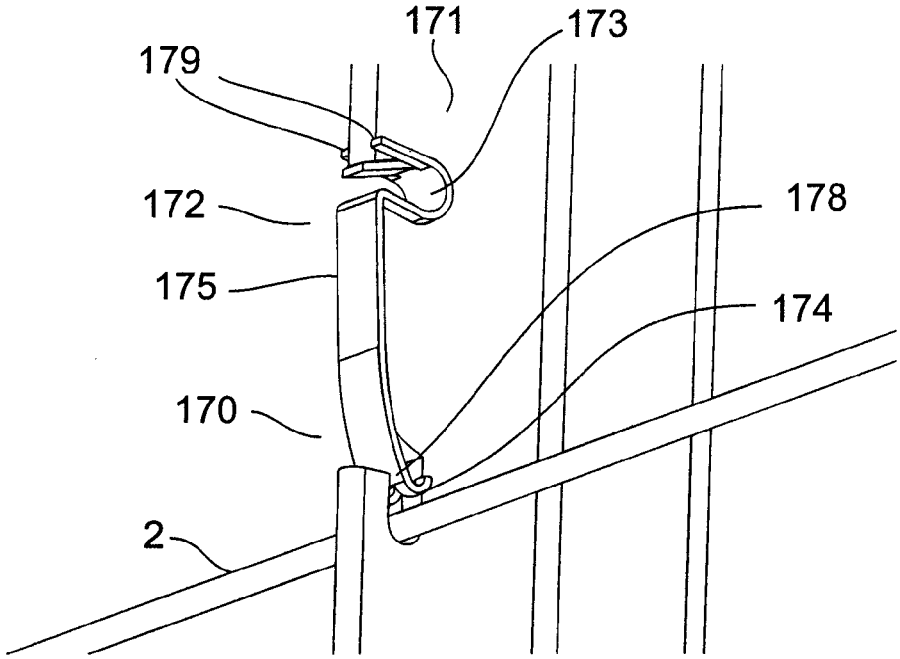
FIG. 22 is a reverse side perspective view corresponding to FIG. 21, but holding a fencing wire.
Figure 23:
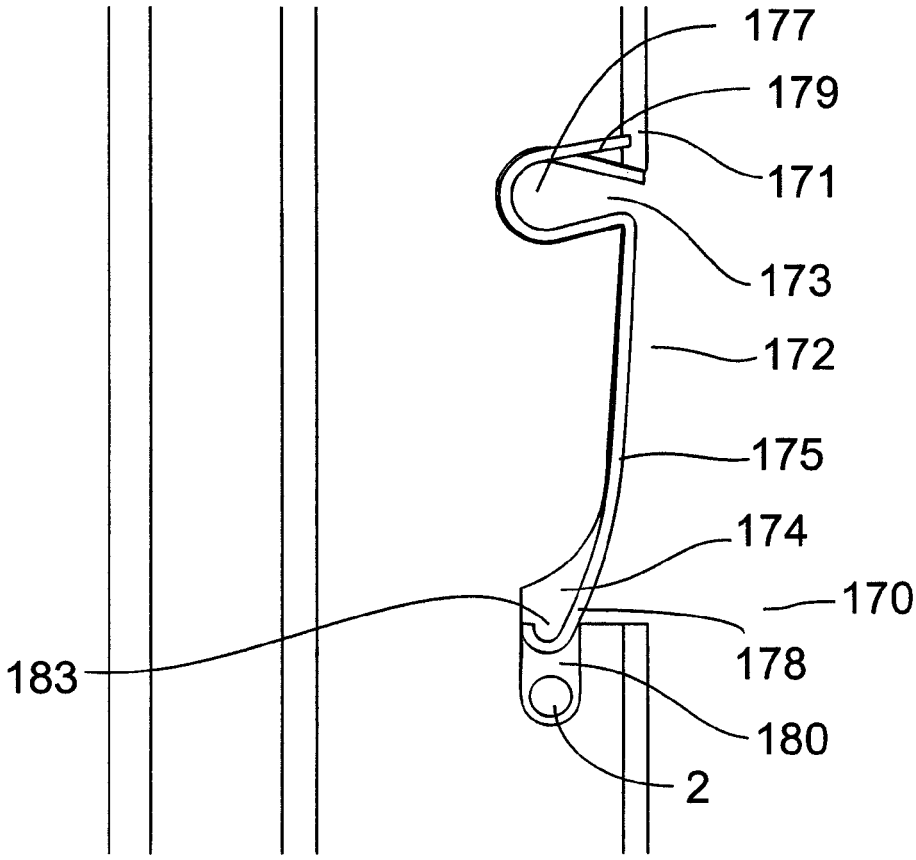
FIG. 23 is a side elevation view corresponding to FIG. 22.
Figure 26:
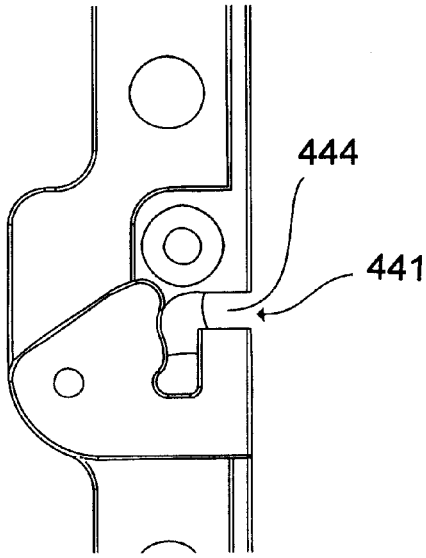
FIG. 26 is a reverse side elevation view of part of the fence post assembly shown in FIG. 24.
Figure 24:
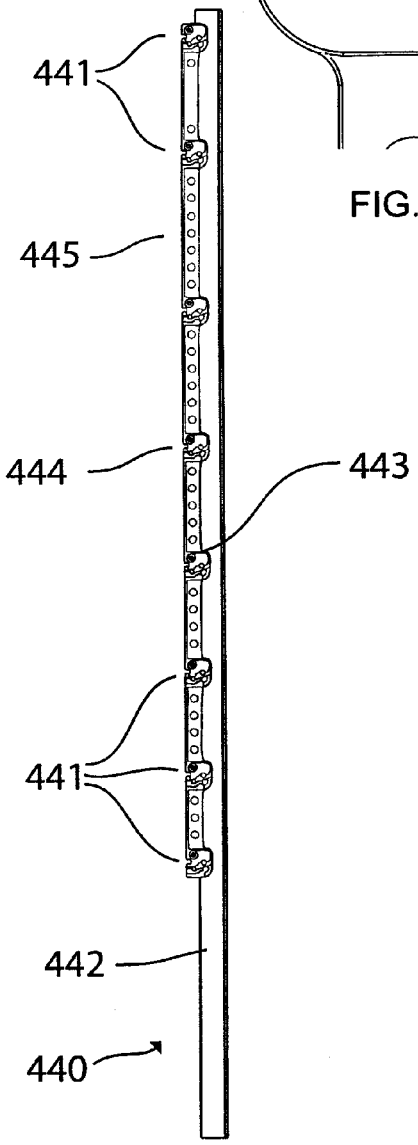
FIG. 24 is a side elevation view of a fence post assembly, according to an embodiment of the present invention.

Turning now to FIGS. 21-23, there is shown a fence post assembly 170 for holding a fencing member such as a wire 2, according to another embodiment of the invention. A fence post 171 of the assembly 170 is in the form of a Y-shape picket. A keeper 172 of the assembly 170 comprises an arcuate upper slot 173, a lower L-shaped slot 174 having a blind end 180, and a metal flat spring retainer 175 that is movable between a fencing member holding position (as shown in FIG. 22) and a fencing member release position.

The flat spring retainer 175 has an arcuate upper portion 177 and a hooked lower portion 178. The arcuate upper portion 177 extends within the upper slot 173 and has a pair of upwardly turned locking tabs 179 that extend along each side of a post 171 arm and together with the arcuate upper portion 177 lock the retainer 175 in position. A portion of the retainer 175 intermediate the upper and lower portions 177, 178 extends along an edge of the post 171 arm. The hooked lower portion 178 extends across the lower slot 174 and is biased to remain in that fencing member holding position. The hooked lower portion 178 has a notch 183 slightly wider than the width of the post 171 arm (see FIG. 21).

The hooked lower portion 178 can move between the fencing member holding and release positions. When inserting a fencing member (eg. a wire 2) into the lower slot 174, the member pushes against the hooked lower portion 178 and against a force of the spring until the notch 183 engages the post 171 and the member is locatable within the blind end 180 of the lower slot 174. The hooked lower portion 178 then returns to a resting position and prevents the fencing member from disengaging the lower slot 174 by accident. In order to release the fencing member from the lower slot 174, the notch 183 of the hooked lower portion 178 must again be moved into temporary engagement with the post 171 arm.

Turning now to FIGS. 27 to 29, there is again shown the fence post assembly 120 of FIGS. 10 to 15, having keepers 122 spaced along a length of the post 121.

The retainer 124 is the same as shown in FIG. 10, except that the travel stop pin 135 and pivot pin 126 each have smaller diameter head.

Figure 28:
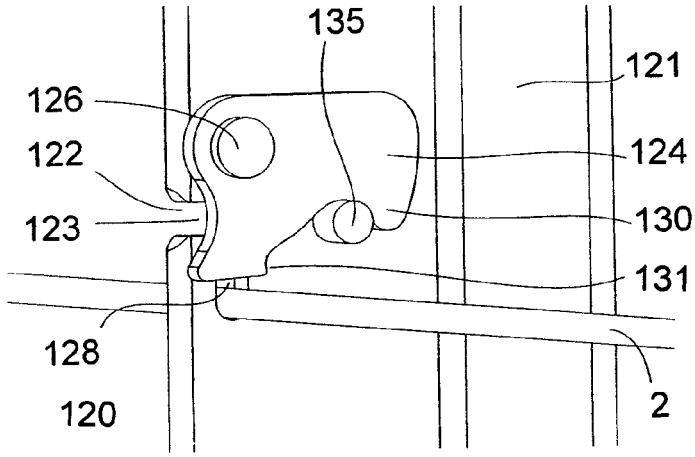
FIG. 28 is the same as that shown in FIG. 27 except that it is holding a fencing wire.
Figure 27:
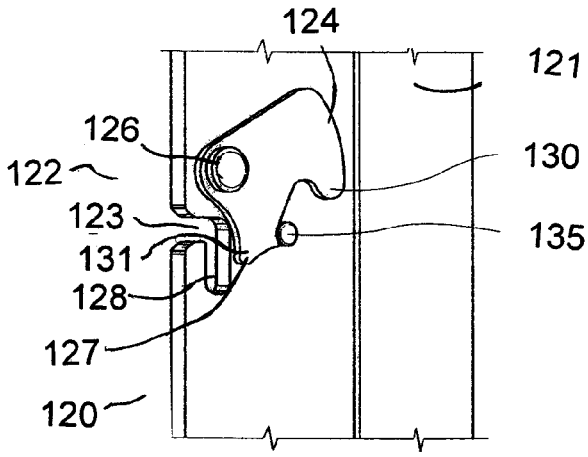
FIG. 27 is a side perspective view of part of a fence post assembly, according to an embodiment of the present invention.

FIG. 28 shows the retainer 124 in the fencing member holding position. FIG. 27 shows how the retainer 124 is pivoted when either accepting or releasing a fencing member wire 2 from the slot 123.

Figure 31:
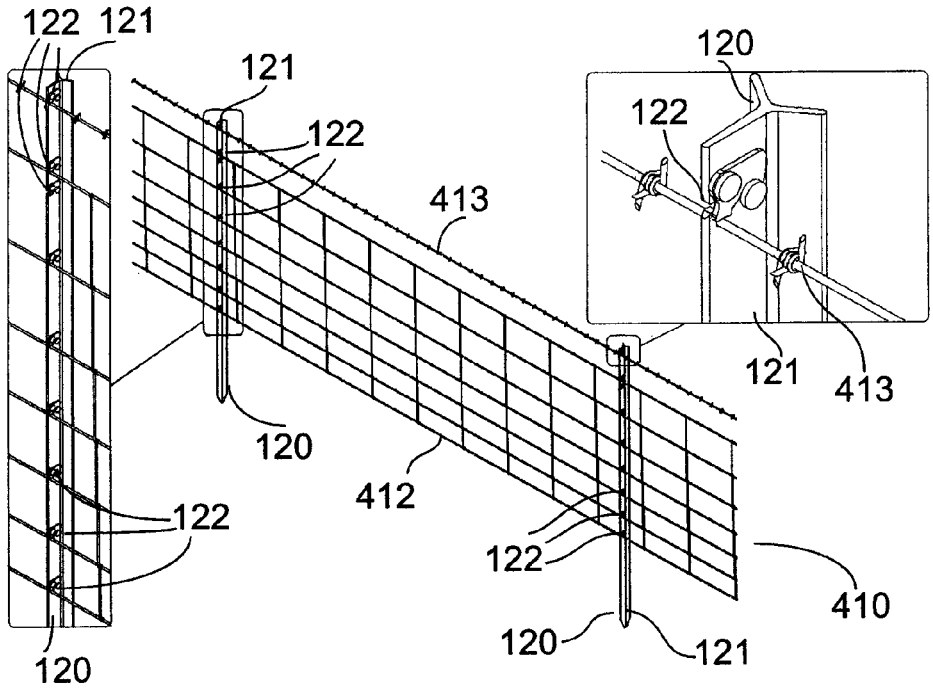
FIG. 31 is a perspective view (and magnified views) of a mesh and barbed wire fence constructed from a fence post assembly of an earlier figure, according to an embodiment of the present invention.
Figure 30:
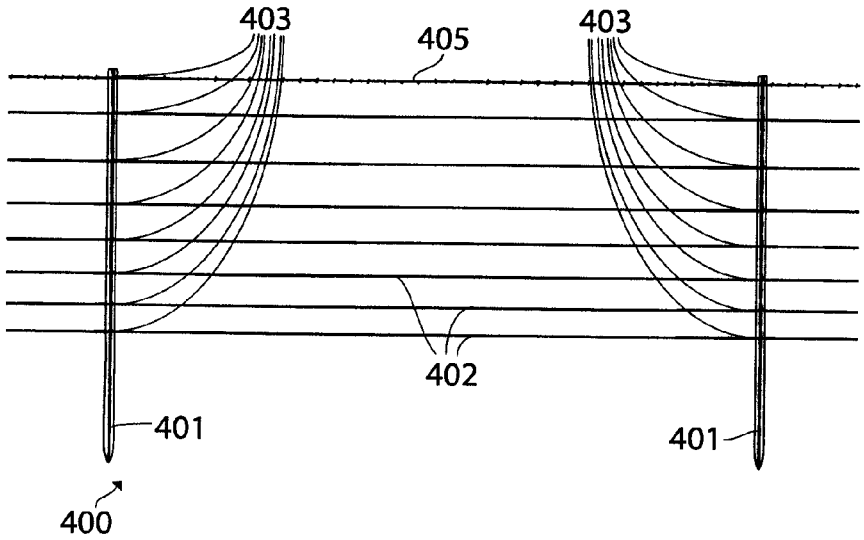
FIG. 30 is an elevation view of a wire fence constructed from any one of the fence post assemblies of the earlier figures, according to an embodiment of the present invention.
Figure 32:
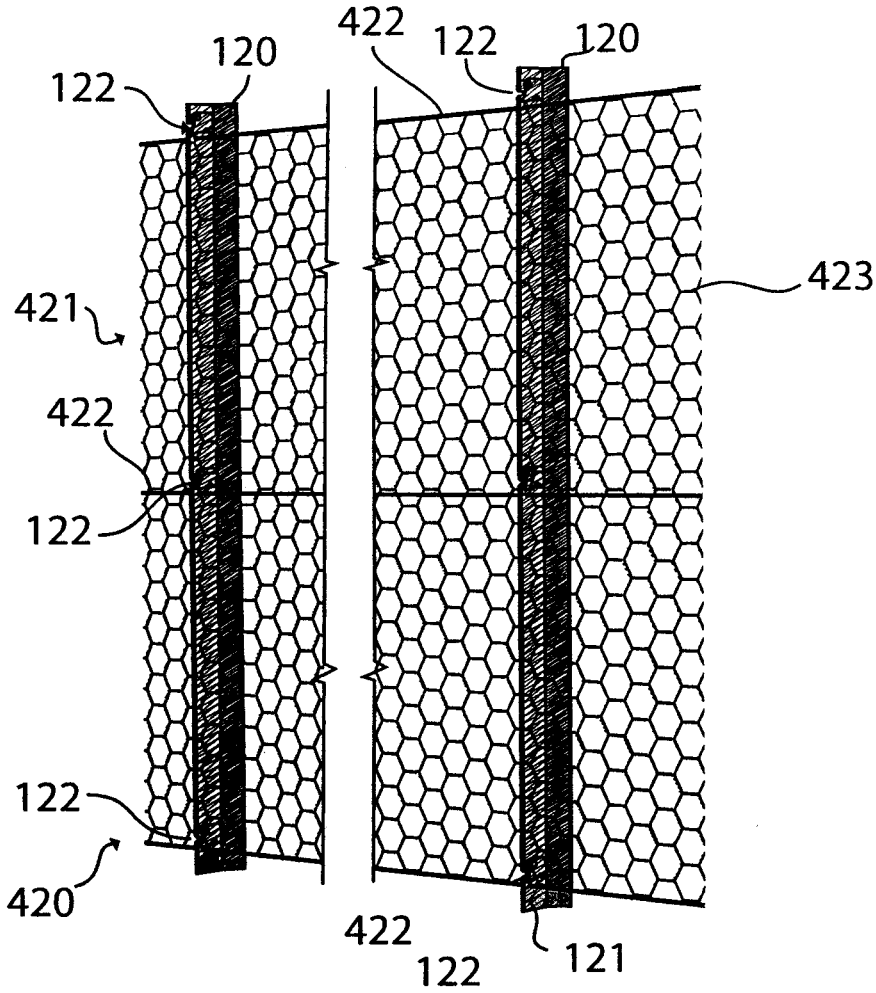
FIG. 32 is a perspective view of a mesh fence constructed from a fence post assembly of an earlier figure, according to an embodiment of the present invention.

FIGS. 30-32 are examples of different types of fences that may be constructed using the fence post assemblies shown in the earlier figures.

In order to construct the wire fence 400 of FIG. 30, posts of the post assemblies 401 are first driven into the ground at the required spacing. All of the plain 402 and barbed 405 fencing wires are then run out at once, tied off to a first strainer post, strained, tied off to a second strainer post, and then brought into engagement with the keepers 403 that are spaced along the length of each post. With the retainers of the keepers 403 in the holding position, if necessary, the wires 402, 405 may then be further strained until completely taut.

Turning now to FIG. 31, there is shown a fence 410 constructed using the fence post assembly 120 of FIGS. 10-15 but utilising a wire mesh panel 412 rather than individual plain wires. However, a barbed wire 413 extends above the mesh panel 412. The mesh panel 412 comprises a repeating pattern of horizontally extending and vertically extending wires.

In order to construct the fence 410, the posts 121 are first anchored to the ground at the required spacing. The mesh panel 412 and barbed wire 413 are then unrolled, tied off to a first strainer post, strained, tied off to a second strainer post, and then the horizontally extending wires of the mesh panel 412 and the barbed wire 413 are brought into engagement with the keepers 122 that are spaced along the length of each post 121. With the retainers of the keepers 122 in the holding position, if necessary, the mesh panel 412 and barbed wire 413 and may then be further strained until completely taut.

Figure 29:
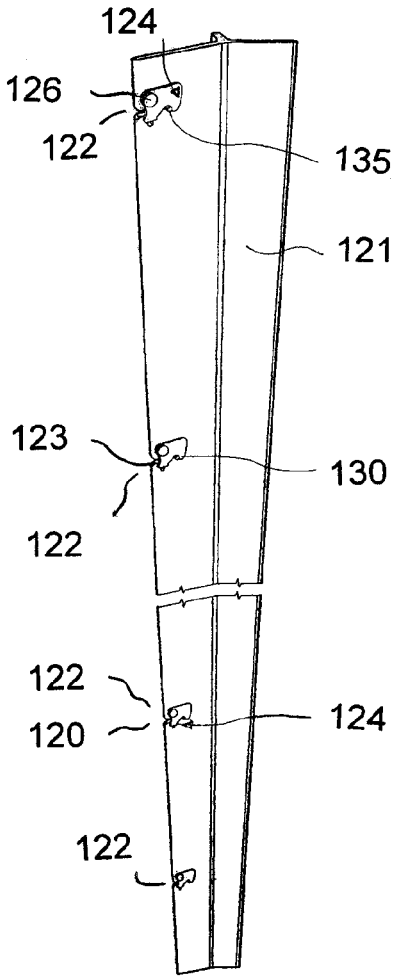
FIG. 29 is a perspective view of the fence post assembly shown in FIG. 27.

Turning now to FIG. 32, there is shown a fence 420 constructed using the fence post assembly 120 like that shown in FIG. 29 but utilising a different type of wire mesh panel 421. The mesh panel 421 comprises a mesh 423 having orthoganol openings and three horizontally extending straining wires 422 that are connected to the mesh 423.

In order to construct the fence 420, the posts 121 are first anchored to the ground at the required spacing. The mesh panel 421 is then unrolled, tied off to a first strainer post, strained, tied off to a second strainer post, and then the horizontally extending wires 422 of the mesh panel 421 are then brought into engagement with the keepers 122 that are spaced along the length of each post 121. With the retainers of the keepers 122 in the holding position, if necessary, the wires 422 and may then be further strained until completely taut.

Figure 25:
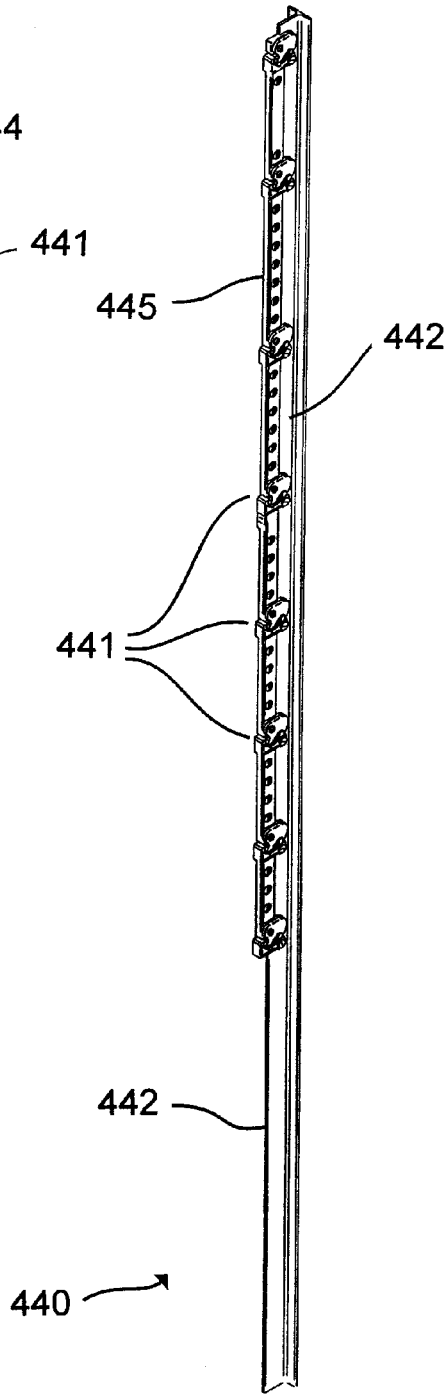
FIG. 25 is a perspective view of that shown in FIG. 24.
Figure 37:
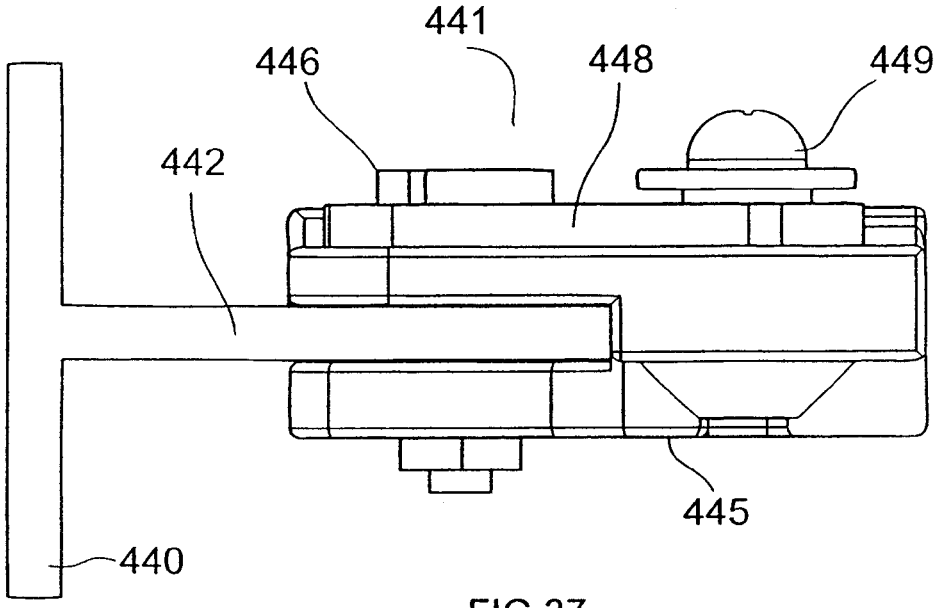
FIG. 37 is a top end view of that shown in FIG. 33.
Figure 35:
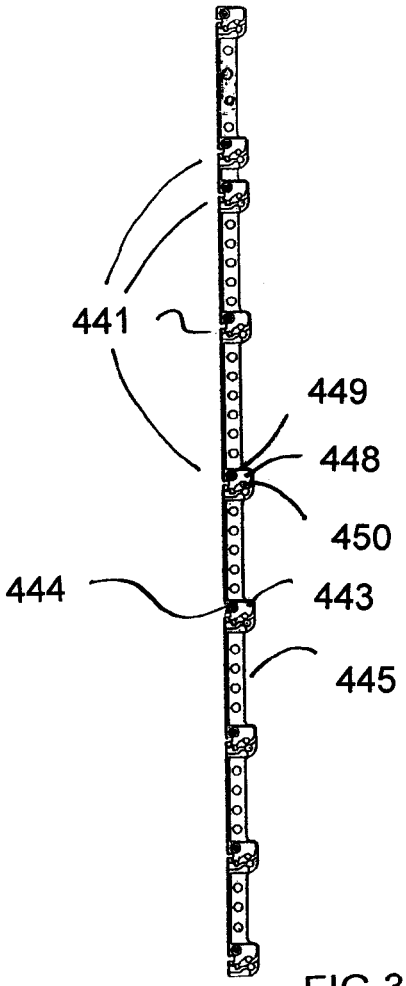
FIG. 35 is a side elevation view of part of the fence post assembly shown in FIG. 33.
Figure 36:
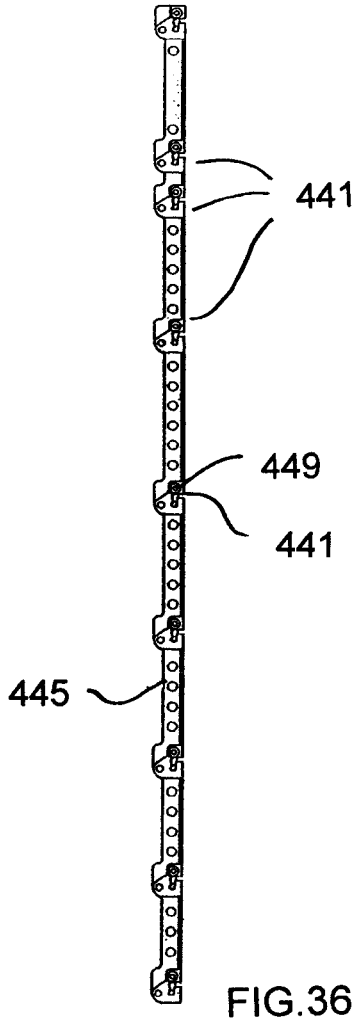
FIG. 36 is a reverse side elevation view of that shown in FIG. 35.

Turning now to FIGS. 24-26 and 33-37, there is shown a fence post assembly 440 having a composite/hybrid post and keepers 441 spaced there along. The post comprises a T-shaped metal support and a plastic strip 445 extending longitudinally along an arm 442 of the support. As seen in FIGS. 25 and 37, strip 445 has pairs of opposed jaws that extend along opposing longitudinal sides of the arm 442 and are securely bolted to the arm 442.

Figure 33:
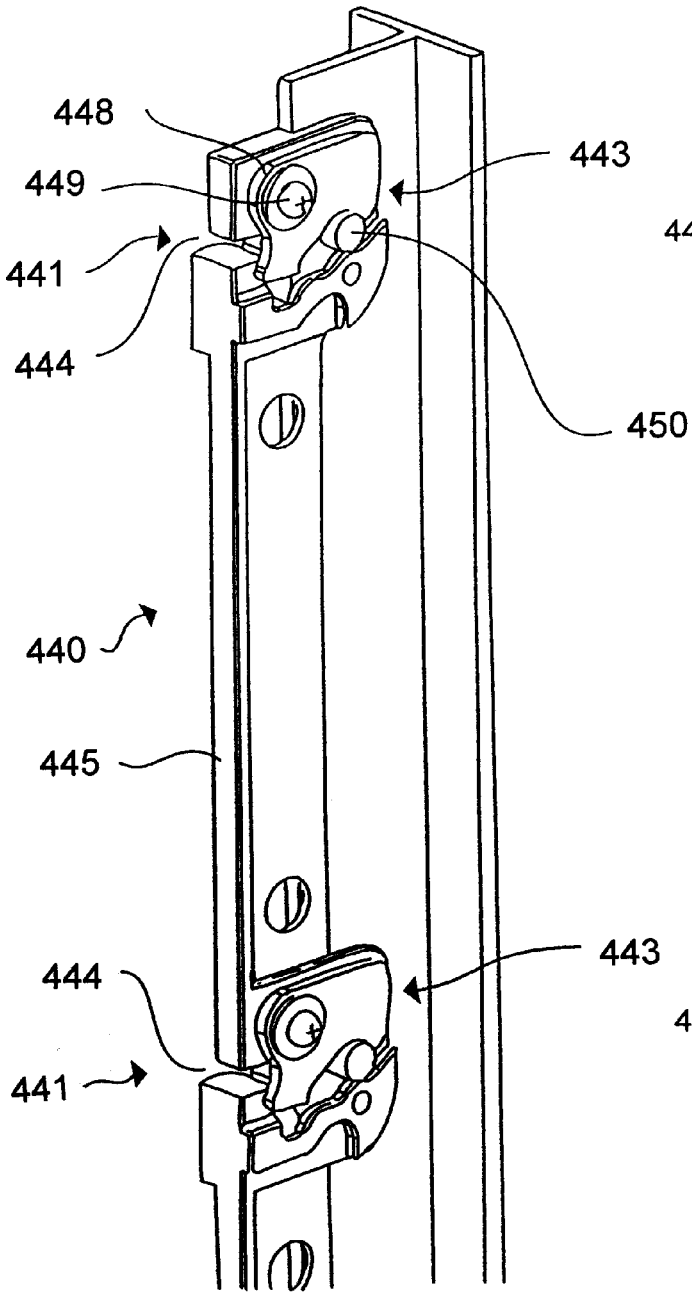
FIG. 33 is close up of that shown in FIG. 25.
Figure 34:
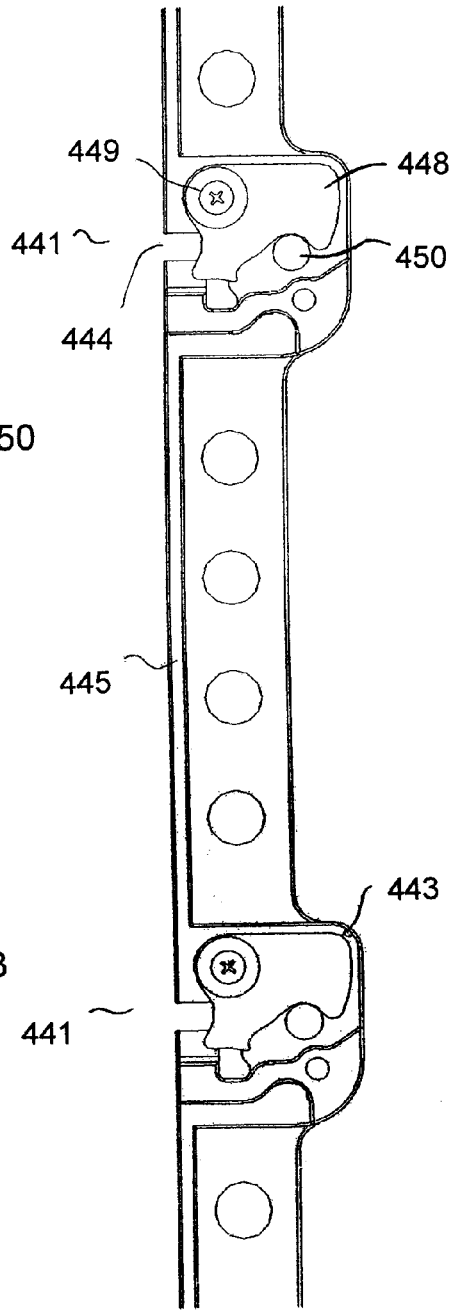
FIG. 34 is close up of that shown in FIG. 24.

A plurality of keepers 441 are positioned along the strip 445. The keepers 441 are essentially the same as keepers 122 shown in FIG. 29. L-shaped slots 444 are formed in the plastic strip 445. Each retainer assembly 443 comprises a retainer 448, a pivot pin 449 and a travel stop pin 450, as seen in FIGS. 33 and 34, and as described in respect of keeper 122.

The number and spacing of keepers and the length of the strip 445 may vary and will depend on its intended use.

FIGS. 49 to 54 show part of a fence post assembly 500 according to another embodiment of the invention. A fence post 501 of the assembly 500 is in the form of a Y-shape picket. A keeper 502 of the assembly 500 comprises an L-shaped slot 503 and a retainer assembly. The retainer assembly comprises a retainer 504 (see FIG. 53) and a pivot pin 505 (see FIG. 54).

Figure 53:
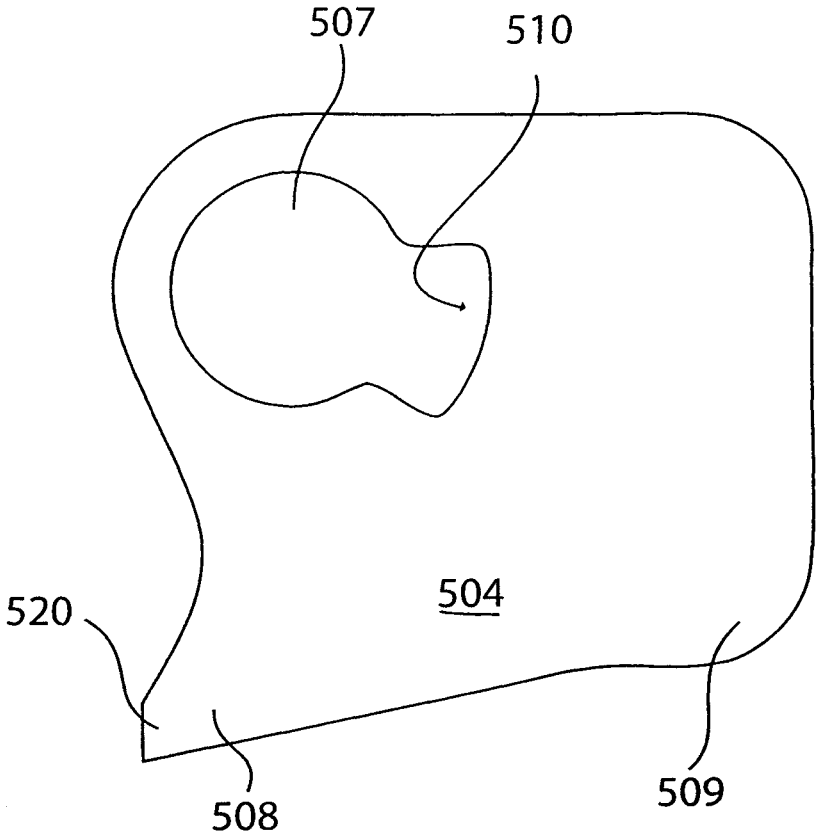
FIG. 53 is a side elevation view of a retainer of the fence post assembly shown in FIG. 50.

The retainer 504 is pivotally mounted to a post 501 arm having a rectangular opening 506 and can pivot between fencing member holding and release positions. As shown in FIG. 53, the retainer 504 comprises a post mounting region having a round opening 507, a fencing member engaging region 508, a counter-balance region 509 and an arcuate cut-out region 510 that extends from the round opening 507.

Figure 51:
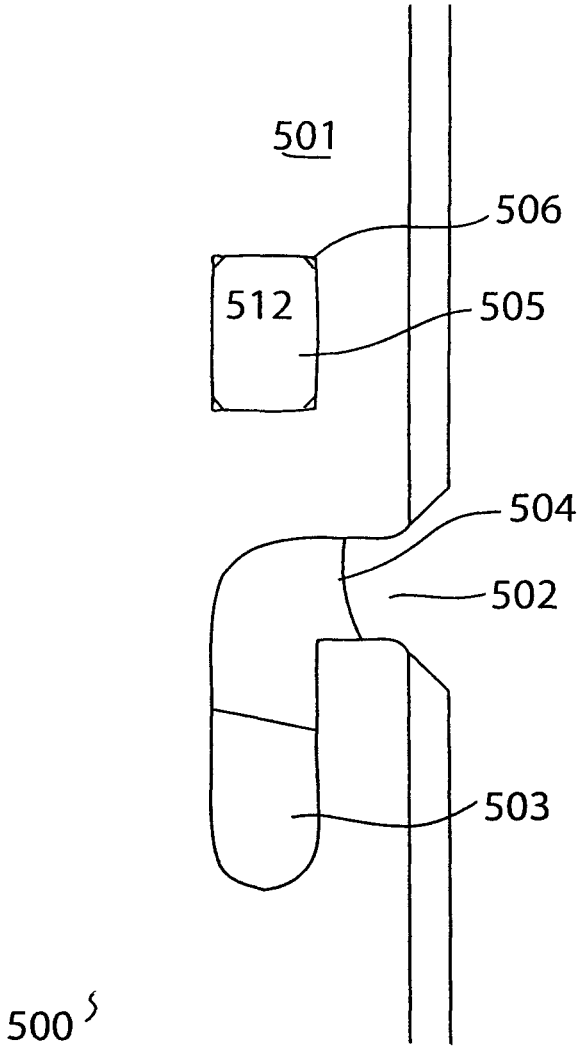
FIG. 51 is a side elevation view opposite of that shown in FIG. 50.
Figure 52:
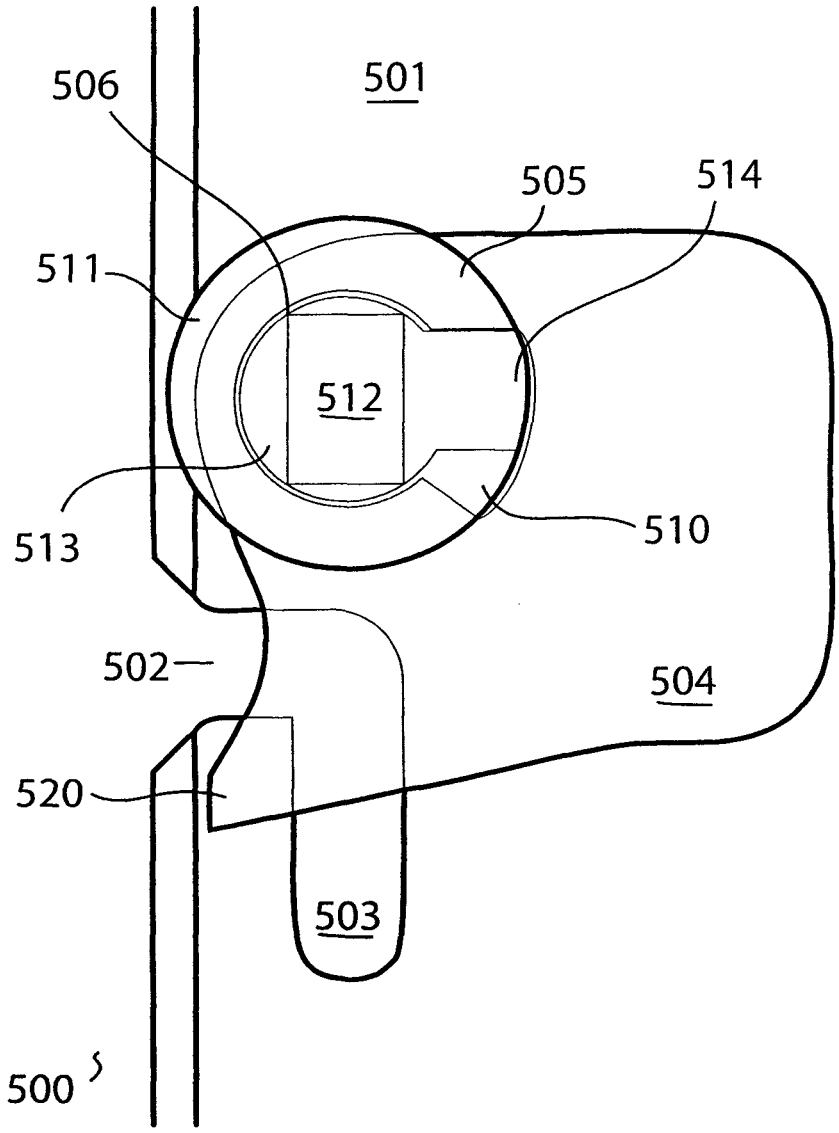
FIG. 52 is a detailed view of that shown in FIG. 50.
Figure 54:
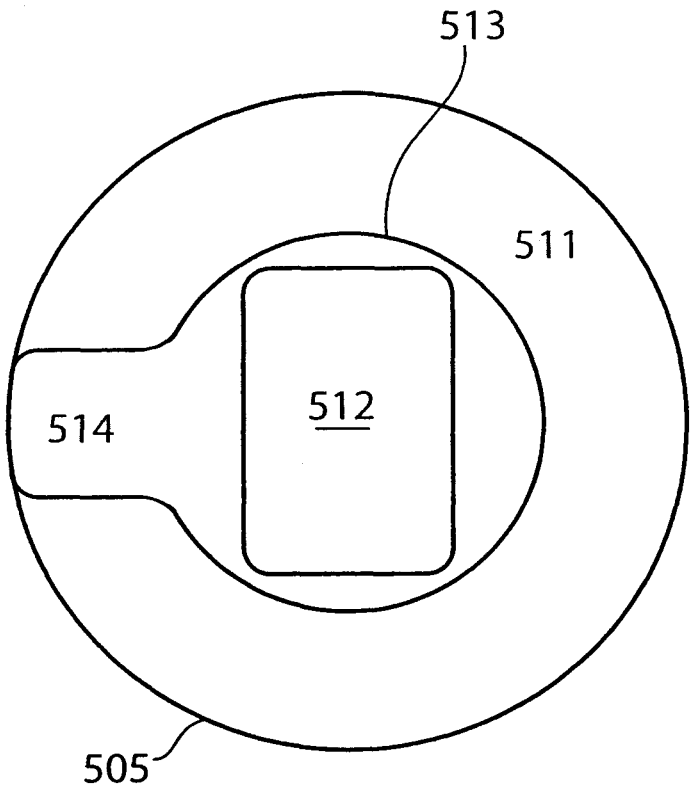
FIG. 54 is an end elevation view of a pivot pin of the fence post assembly shown in FIG. 50.

As seen in FIGS. 51-52 and 54 the pivot pin 505 has an enlarged head 511, a rectangular tail 512 and a round shank 513 extending between the head 511 and tail 512. The tail 512 engages the rectangular opening 506 in the post arm 501. The retainer 504 is retained between the head 511 and post arm 501. A lateral extension 514 of the pivot pin 505 extends from the shank 514 and extends within the arcuate cut-out region 510 of the retainer 504 as seen in FIG. 52. The lateral extension 514 serves as a travel stop, allowing the retainer 504 to pivot only through an angle provided by the arcuate cut-out region 510.

The fencing member engaging region 508 has a tapered nose 520 that is shaped to both allow a fencing member to locate within a blind end of the slot 503 and to be retained within the blind end.

FIGS. 49-52 shows the retainer 504 in the fencing member holding position. When inserting a fencing wire into the slot 503, the fencing wire engages the tapered nose 520 and pushes the fencing member engaging region 508 downwardly. The fencing wire then locates within the blind end of the slot 503, at which time the fencing member engaging region 508 pivots back to the holding position due to the weight of the counter-balance region 509. The lateral extension 514 (travel stop) resists further downward movement of the counter-balance region 509 and ensures that the fencing wire cannot disengage the slot 503 by accident. In order to release the fencing wire from the slot 503, the fencing member engaging region 508 must be pivoted downwardly by hand, such that the fencing wire can freely move to an open end of the slot 503.

An advantage of some embodiments of the present invention is that fencing wires and mesh panels can be readily attached to fence posts in one simple operation. The fencer need not thread wires through holes of Y- or T-shape picket posts. The fencer can run out all of the fencing wires at once along the whole length of the fence and readily attach the wires to the posts. In this way, several trips along a length of the fence by the fencer may be avoided.

Where mesh panel fencing is required, this can be prefabricated, and the entire fence can be run out, tied off and strained by the fencer, then brought into engagement with the keepers and then finally strained and tied off, if required. This saves the fencer having to first thread plain wires through the holes of each post, then straining those wires, then attaching the mesh panel, and then having to strain the mesh panel.

Another advantage of some embodiments of the present invention is that posts can be readily added to, or removed from, an existing fence without having to cut any wires. A new post is driven into the appropriate place and the wires are simply inserted into the slots of the keepers. Likewise, when removing a post, the wires are released from the post and the post is then removed.

Also, in the event that a fence needs to be dismantled, the wires are simply released from the fence posts, unstrained and laid on the ground and rolled up. There is no need to cut any wires or need to feed them back along the entire length of fence through each hole in each post-often an impossible task on older fences and rarely undertaken due to time costs.

Yet another advantage of some embodiments is that the fence can be readily relocated or recycled in that the wires or wire mesh panel can be easily detached from the posts without first cutting those wires.

Figure 38:
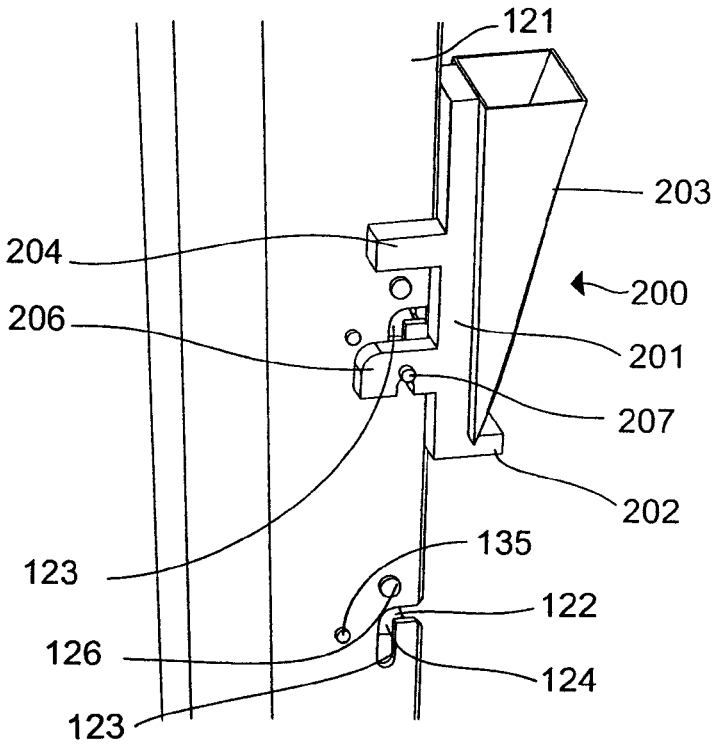
FIG. 38 is a side perspective view of a rain gauge fencing member being held by a fence post assembly like that shown in an earlier figure, according to an embodiment of the present invention.

Turning now to FIG. 38, there is shown a rain gauge fencing member 200 being held by a fence post assembly 120 like that shown in FIGS. 10-15.

The rain gauge fencing member 200 has an elongate support body 201 and a lower end of the body 201 has a ledge 202. A wedge shaped rain collecting vessel 203 is supported by the body 201. A pair of positioning arms 204 extends laterally of the body 201 and straddles the post 121 arm. A pair of pin support arms 206 extends laterally of the body 201 and straddles the post 121 arm. A locking pin 207 extends between the pin support arms 206 and is retainable within the slot 123 of the keeper 122 by the retainer 124 (as described previously in respect of fencing wire 2). The lower end of the body 201 prevents the member 200 from pivoting about pin 207 when held by the keeper 122. The pin support arms 206 provide clearance for pivoting of the retainer 124 between the holding and release positions.

Figure 39:
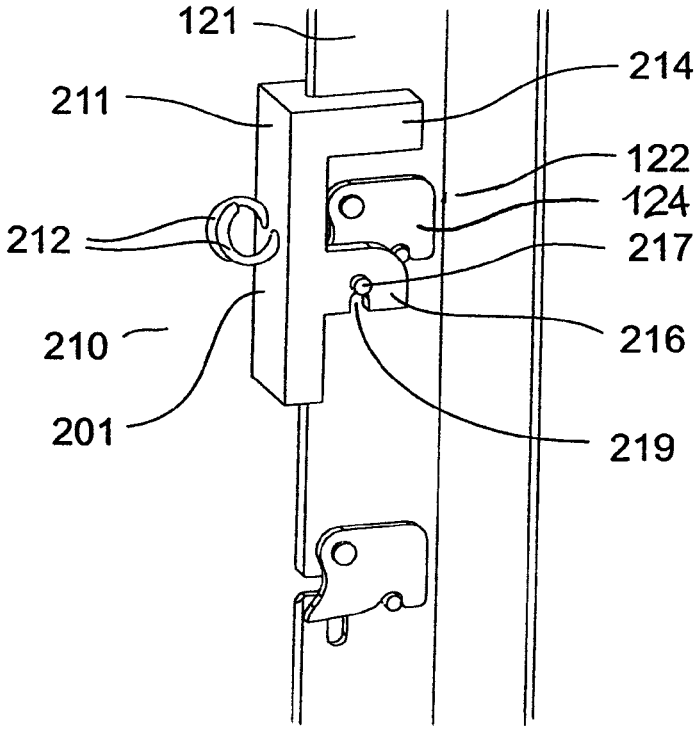
FIG. 39 is a side perspective view of a small ring insulator fencing member being held by a fence post assembly like that shown in an earlier figure, according to an embodiment of the present invention.
Figure 40:
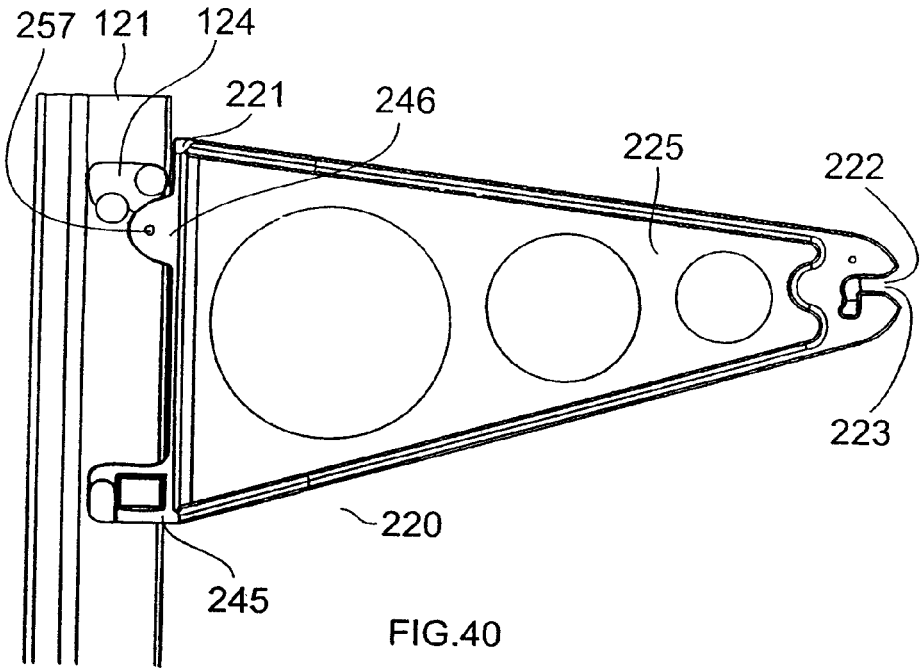
FIG. 40 is a side elevation view of an insulator fencing member being held by a fence post assembly like that shown in an earlier figure, according to an embodiment of the present invention.

Turning now to FIG. 39, there is shown a small ring insulator fencing member 210 being held by a fence post assembly like that shown in FIGS. 10-15.

The small ring insulator fencing member 210 has an elongate body 211. A pair of insulator hooks 212 are supported by the body 201. A pair of positioning arms 214 extends laterally of the body 211 and straddles the post 121 arm. A pair of pin support arms 216 extends laterally of the body 211 and straddles the post 121 arm. A locking pin 217 extends between the pin support arms 216 and is retainable within the slot 123 of the keeper 122 by the retainer 124 (as described previously in respect of rain gauge fencing member 200). The lower end of the body 211 prevents the member 210 from pivoting about pin 217 when held by the keeper 122. The pin support arms 216 provide clearance 219 for pivoting of the retainer 124 between the holding and release positions.

Turning now to FIGS. 40 to 44, there is shown an insulator fencing member 220 being held by a fence post assembly like that shown in FIGS. 10 to 15.

Figure 41:
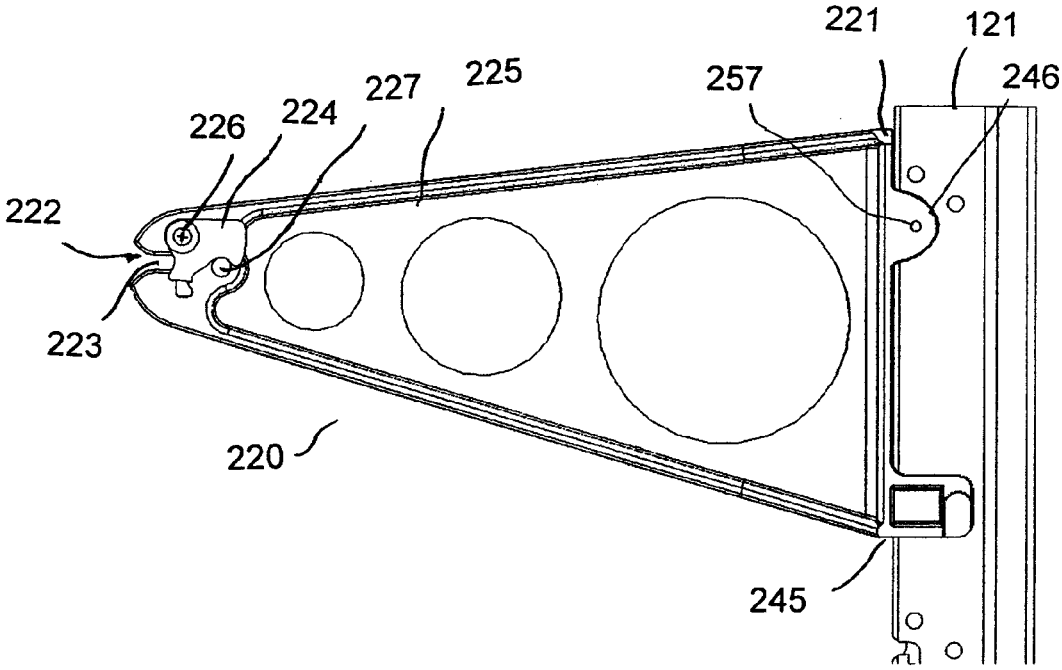
FIG. 41 is a reverse side elevation view of that shown in FIG. 40.
Figure 42:
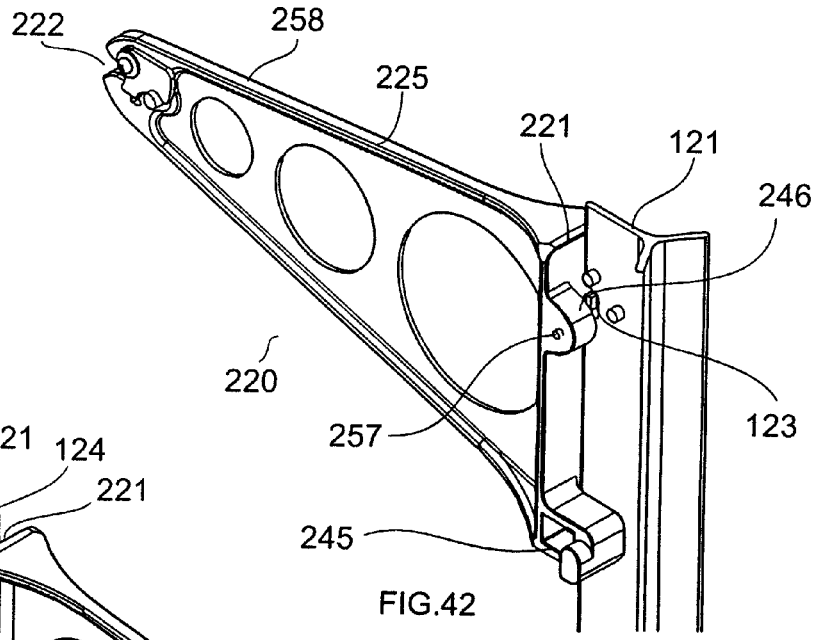
FIG. 42 is a side perspective view of that shown in FIG. 41.
Figure 44:
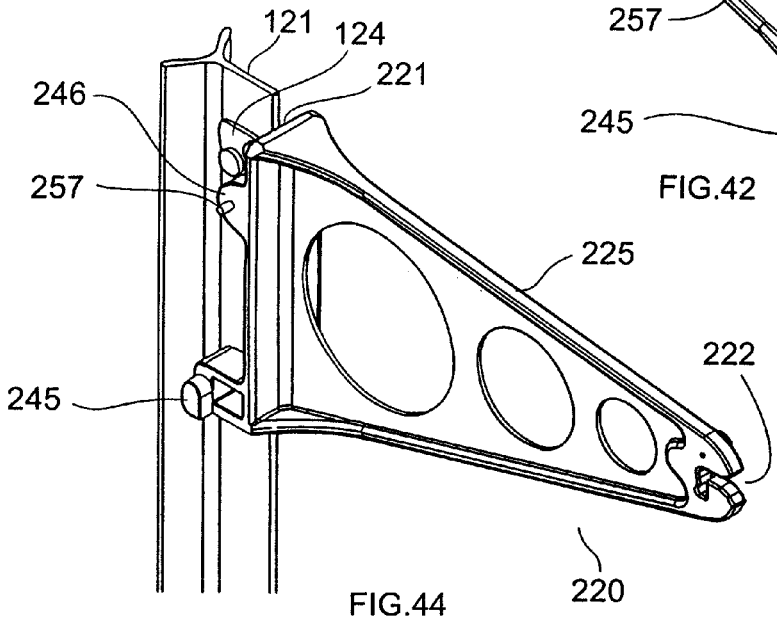
FIG. 44 is a reverse side perspective view of that shown in FIG. 42.
Figure 43:
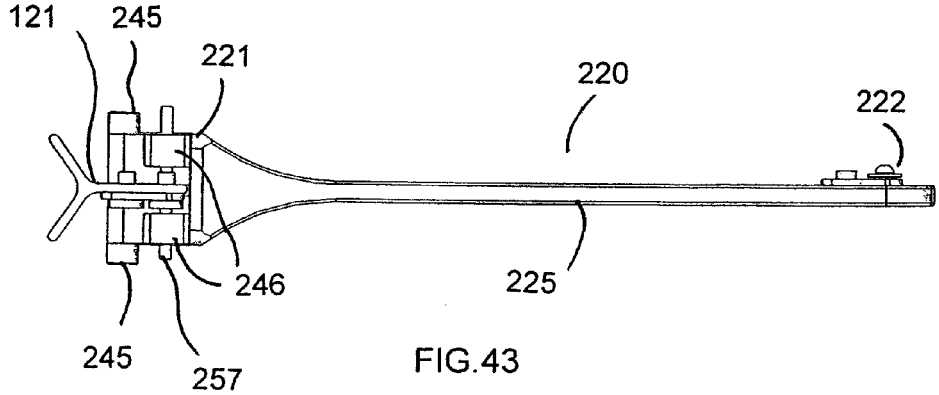
FIG. 43 is a top plan view of that shown in FIG. 40.

The insulator fencing member 220 has an elongate body 221 and a tapered insulator bracket 225 extending laterally of the elongate body 221. The bracket 225 has a reinforced rim 258 as seen in FIG. 42. A keeper 222, like keeper 122, is located at a narrow end of the bracket 225. Keeper 222 comprises an L-shaped slot 223 and a retainer assembly, for retaining a fencing member, such as an electrified wire. As seen in FIG. 41, the retainer assembly comprises a retainer 224, a pivot pin 226 and a travel stop pin 227.

A pair of positioning arms 245 extends laterally and rearwardly of a lower end of the body 221 and straddles the post 121. A pair of pin support arms 246 extends laterally of an upper end of body 221 and straddles the post 121. A locking pin 257 extends between the pin support arms 246 and is retainable within the slot 123 of the keeper 122 by the retainer 124 (as described previously). The lower end of the body 221 prevents the member 220 from pivoting about pin 257 when held by the keeper 122. The pin support arms 246 provide clearance for pivoting of the retainer 124 between the holding and release positions.

Figure 47:
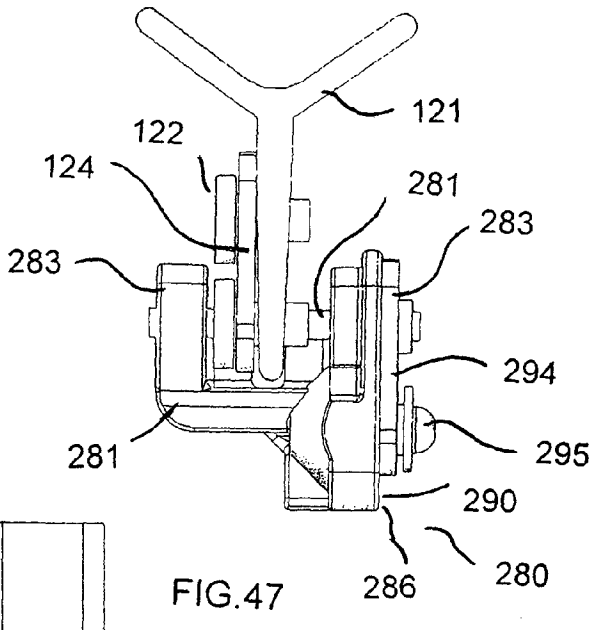
FIG. 47 is a top plan view of that shown in FIG. 45.
Figure 46:
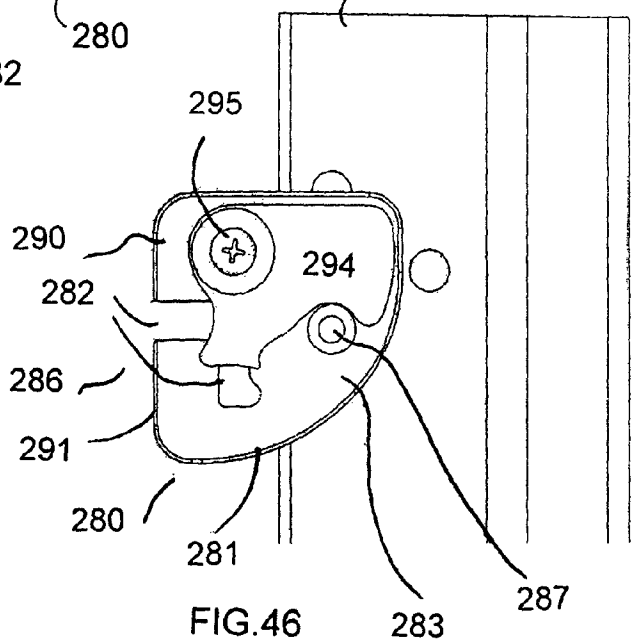
FIG. 46 is a side elevation view of that shown in FIG. 45.
Figure 45:
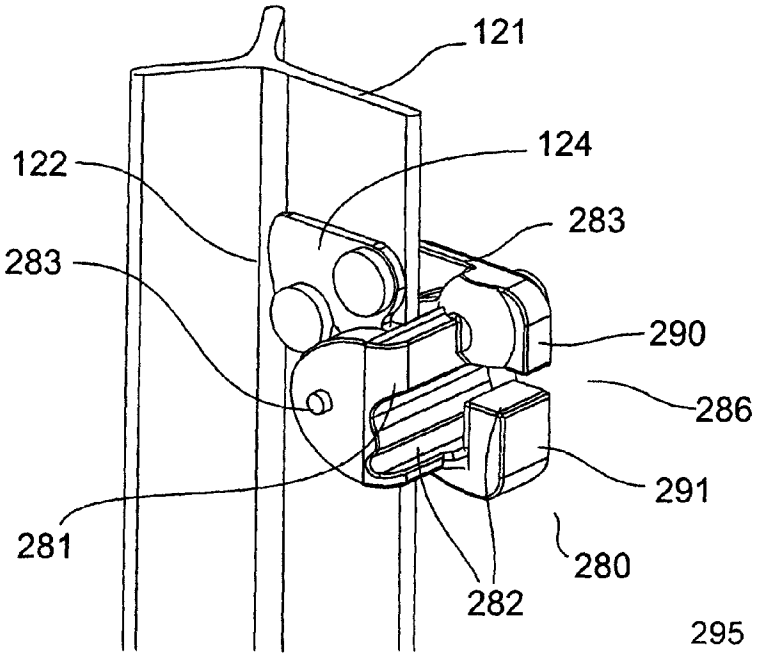
FIG. 45 is a perspective view of an insulator fencing member being held by a fence post assembly like that shown in an earlier figure, according to an embodiment of the present invention.

Turning now to FIGS. 45 to 47, there is shown another insulator fencing member 280 being held by a fence post assembly like that shown in FIGS. 10 to 15.

The insulator fencing member 280 has a body 281 and a pair of pin support arms 283 extends laterally of the body 281 and straddles the post 121. A locking pin 287 extends between the pin support arms 283 and is retainable within the slot (not shown) of the keeper 122 by the retainer 124 (as described previously). A lower end of the body 281 prevents the member 280 from pivoting about pin 287 when held by the keeper 122. The pin support arms 283 provide clearance for pivoting of the retainer 124 between the holding and release positions.

The body 281 also has a retainer assembly 286 for holding a fencing member such as an electrified wire. Upper and lower walls 290, 291 extend forwardly of the body 281 and provide a slot/recess 282 of the retainer assembly 286. As seen in FIG. 46, the retainer assembly comprises a retainer 294, a pivot pin 295 and a travel stop pin 287 (ie. locking pin 287).

In use, a wire is inserted within the slot/recess 282 such that the retainer 294 pivots to the release position and allows the wire to be placed within a blind end of the slot/recess 282. The retainer 294 then returns to the holding position and holds the wire in place.

Yet another advantage of some embodiments of the present invention is that fencing members, such as those described above, can be readily attached to fence posts having keepers as described herein.

Figure 48:
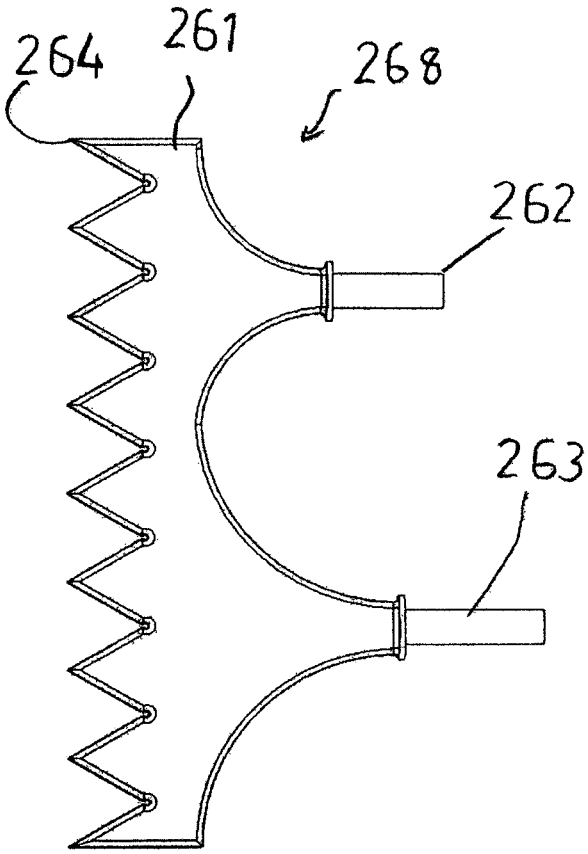
FIG. 48 is a side perspective view of a fencing wire locator, according to an embodiment of the present invention.
Figure 49:
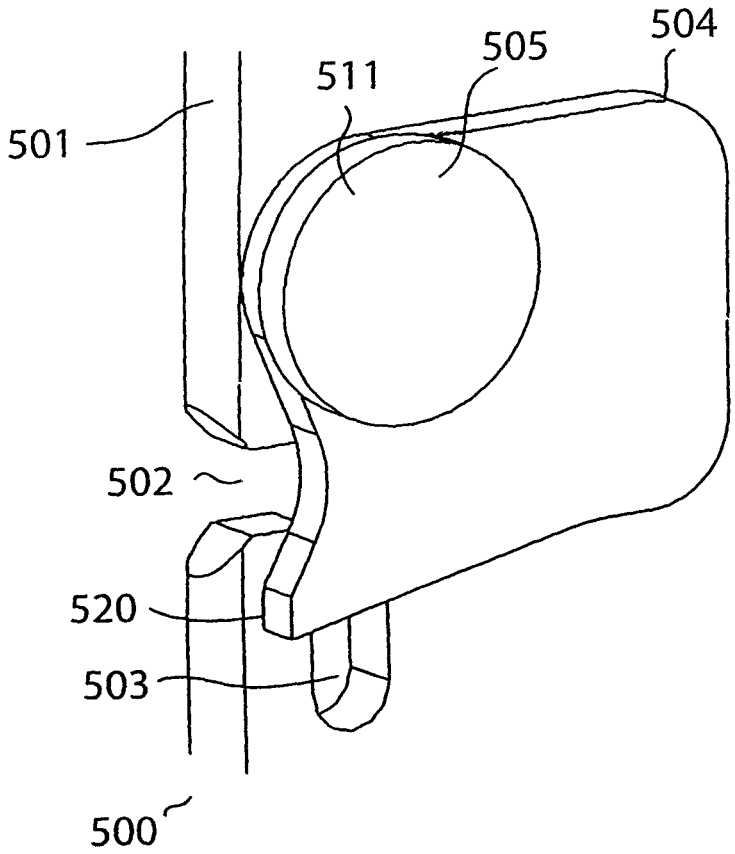
FIG. 49 is a side perspective view of part of a fence post assembly, according to an embodiment of the present invention.
Figure 50:
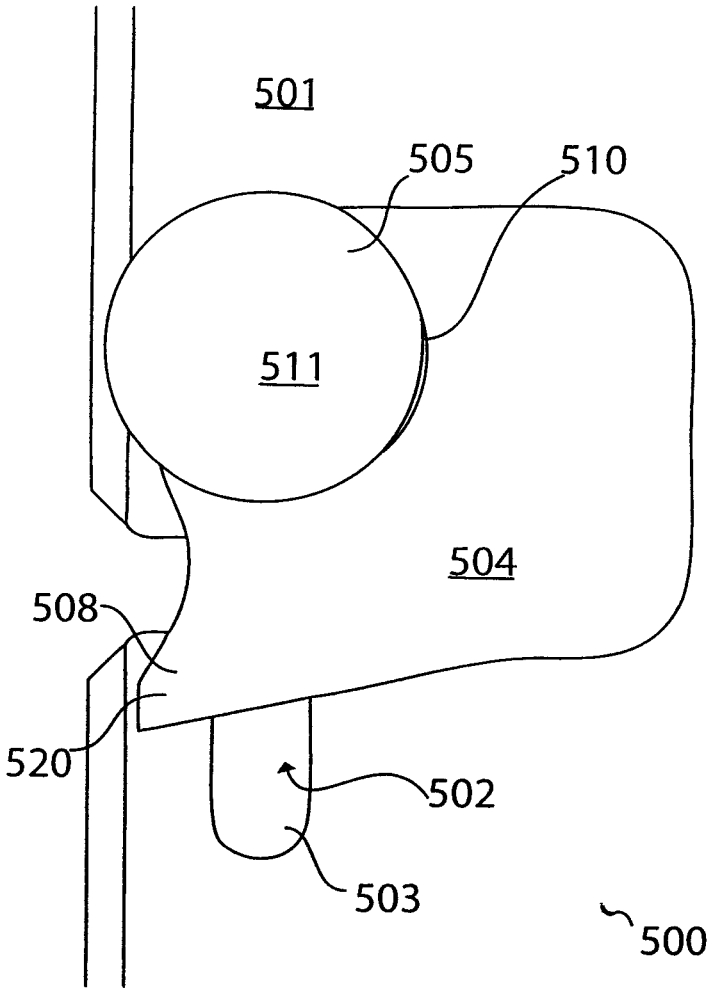
FIG. 50 is a side elevation view of that shown in FIG. 49.

Turning now to FIG. 48, there is shown a fencing wire locator 268, according to an embodiment of the present invention. The locator 268 is used to insert fencing wires as a group or a wire mesh panel into the slots of keepers of a fence post, such as the posts and keepers described in the earlier embodiments herein.

The locator 268 has an elongate body 261, a pair of handles 262, 263 extending from the body 261, and a row of teeth 264 extending from the body 261.

In use, either plain fencing wires or wires of a wire mesh panel are made to engage the teeth 264 and the teeth 264 are then moved by an installer relative to the post such that each wire engages its respective keeper (one at a time). That is, the installer walks up to the post, jiggles the locator 268 until all of the wires engage the teeth 264 and align with one another, and then pushes the locator 268 against the post until all of the wires have engaged their respective keepers.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

What is claimed is:

1. A fence post assembly for holding a fencing member comprising:

a fence post comprising at least one longitudinally extending arm having a longitudinal edge; and at least one keeper capable of holding the fencing member within the at least one arm, wherein the at least one keeper comprises:

at least one slot extending within the at least one arm from the longitudinal edge and having a blind end capable of receiving a fencing member; and at least one retainer assembly comprising a plate or sheet retainer, wherein the retainer is exterior to the slot and comprises:

a post mounting region at which the retainer is pivotally connected to the at least one arm at a pivot point and rotatable alongside and substantially parallel with the at least one arm between a holding position and a release position; and a fencing member engaging region, wherein in the holding position the fencing member engaging region extends across the slot at a point in substantially vertical alignment with the pivot point, is adapted to retain a fencing member within the blind end of the slot and is positioned so as not to be placed under load by a fencing member should the fencing member be subjected to a substantially horizontal force in the direction of the longitudinal edge.

2. The fence post assembly of claim 1, wherein the retainer is biased to automatically return from the release position to the holding position.

3. The fence post assembly of claim 1, wherein the post mounting region is pivotally mounted to the at least one arm at the pivot point by way of a pin of the retainer assembly.

4. The fence post assembly of claim 3, wherein the fencing member engaging region extends across the slot vertically in line with the pin when the retainer is in the holding position.

5. The fence post assembly of claim 3, wherein the retainer further comprises a counter-balance region to bias the retainer to the holding position under the influence of gravity, wherein in the holding position the counter-balance region is positioned alongside the at least one arm and exterior to the slot.

6. The fence post assembly of claim 3, wherein the pin of the retainer assembly comprises an enlarged head, such that the retainer is positioned between the head and the at least one arm.

7. The fence post assembly of claim 3, wherein the pin of the retainer assembly is adapted to prevent the retainer from rotating substantially beyond the holding and release positions.

8. The fence post assembly of claim 1, wherein the slot follows a substantially L or J-shaped path.

9. The fence post assembly of claim 1, wherein the retainer is shaped to pivot in a first direction to the holding position under the influence of gravity.

10. The fence post assembly of claim 9, wherein the retainer is pivotable in a second direction opposite to the first direction such that a fencing member is able to be moved to the blind end of the slot.

11. The fence post assembly of claim 1, wherein the at least one keeper is adapted to retain a fencing member selected from the group consisting of a plain wire, a barbed wire and a mesh panel.

12. The fence post assembly of claim 1, wherein the at least one keeper is adapted to retain a fencing member selected from the group consisting of an insulator, a bracket, a rain gauge, and a member capable or designed to fit within the blind end of the slot.

13. The fence post assembly of claim 1, wherein the fence post assembly comprises a plurality of said keepers spaced along a length of the at least one arm of the post.

14. The fence post assembly of claim 1, wherein the fence post assembly comprises a plurality of said keepers spaced along a length of the at least one arm, and the keepers are adapted to hold a fencing member comprising a mesh panel.

15. The fence post assembly of claim 1, wherein the at least one arm of the post comprises a longitudinal metallic portion and a non-metallic portion extending longitudinally along the metallic portion, wherein the non-metallic portion has a plurality of keepers spaced along a length of the non-metallic portion.

16. The fence post assembly of claim 15, wherein the non-metallic portion is a non-conductive material strip connectable to the metallic portion.

17. The fence post assembly of claim 1, wherein the retainer is substantially planar.

18. The fence post assembly of claim 1, wherein the retainer assembly further comprises a travel stop independent of the slot that prevents the retainer from rotating substantially beyond the holding and release positions.

19. The fence post assembly of claim 18, wherein the travel stop is a projection extending laterally from said at least one arm that engages the retainer.

20. The fence post assembly of claim 18, wherein the travel stop engages the retainer when in the holding position.

21. The fence post assembly of claim 18, wherein the travel stop of the retainer assembly comprises an enlarged head, such that when the retainer is in the holding position the retainer is positioned between the head and the at least one arm.

22. The fence post assembly of claim 1, wherein the retainer is a plate.

23. A fence post assembly for holding a fencing member comprising:

a fence post comprising a non-conductive material strip that forms part of an arm of the fence post and is connectable to a longitudinal edge of a metallic arm of the fence post at a mating longitudinal edge of the non-conductive material strip, wherein the non-conductive material strip includes an outer longitudinal edge that is distal from the mating longitudinal edge of the non-conductive material strip; and at least one keeper capable of holding the fencing member within the non-conductive material strip, wherein the at least one keeper comprises:

at least one slot extending within the non-conductive material strip from the outer longitudinal edge and having a blind end capable of receiving a fencing member; and at least one retainer assembly comprising a plate or sheet retainer, wherein the retainer is exterior to the slot and comprises:

a post mounting region at which the retainer is pivotally connected to the non-conductive material strip at a pivot point and rotatable alongside and substantially parallel with the non-conductive material strip between a holding position and a release position; and a fencing member engaging region, wherein in the holding position the fencing member engaging region extends across the slot at a point in substantially vertical alignment with the pivot point, is adapted to retain a fencing member within the blind end of the slot and is positioned so as not to be placed under load by a fencing member should the fencing member be subjected to a substantially horizontal force in the direction of the outer longitudinal edge.

24. The fence post assembly of claim 23, wherein the slot follows a substantially L or J-shaped path.

25. The fence post assembly of claim 23, wherein the retainer is shaped to pivot in a first direction to the holding position under the influence of gravity and the retainer is pivotable in a second direction opposite to the first direction such that a fencing member is able to be moved to the blind end of the slot.

26. The fence post assembly of claim 23, wherein the retainer assembly further comprises a travel stop independent of the slot that prevents the retainer from rotating substantially beyond the holding and release positions.

27. The fence post assembly of claim 23, wherein the fence post assembly comprises a plurality of said keepers spaced along a length of the non-conductive material strip.

28. The fence post assembly of claim 23, wherein the post mounting region is pivotally mounted to the non-conductive material strip at the pivot point by way of a pin of the retainer assembly.

29. A fence post assembly comprising:

a fence post comprising at least one longitudinally extending arm having a longitudinal edge;

at least one fencing member; and at least one keeper capable of holding the fencing member within the at least one arm, wherein the at least one keeper comprises:

at least one slot extending within the at least one arm from the longitudinal edge and having a blind end capable of receiving a fencing member; and at least one retainer assembly comprising a plate or sheet retainer, wherein the retainer is exterior to the slot and comprises:

a post mounting region at which the retainer is pivotally connected to the at least one arm at a pivot point and rotatable alongside and substantially parallel with the at least one arm between a holding position and a release position; and a fencing member engaging region, wherein in the holding position the fencing member engaging region extends across the slot at a point in substantially vertical alignment with the pivot point, is adapted to retain a fencing member within the blind end of the slot and is positioned so as not to be placed under load by a fencing member should the fencing member be subjected to a substantially horizontal force in the direction of the longitudinal edge.

30. The fence post assembly of claim 29, wherein the at least one fencing member is selected from the group consisting of a plain wire, a barbed wire, a mesh panel, an insulator, a bracket and a rain gauge.

31. A fence post assembly comprising:

a fence post comprising a non-conductive material strip that forms part of an arm of the fence post and is connectable to a longitudinal edge of a metallic arm of the fence post at a mating longitudinal edge of the non-conductive material strip, wherein the non-conductive material strip includes an outer longitudinal edge that is distal from the mating longitudinal edge of the non-conductive material strip;

at least one fencing member; and at least one keeper capable of holding the fencing member within the non-conductive material strip, wherein the at least one keeper comprises:

at least one slot extending within the non-conductive material strip from the outer longitudinal edge and having a blind end capable of receiving a fencing member; and at least one retainer assembly comprising a plate or sheet retainer, wherein the retainer is exterior to the slot and comprises:

a post mounting region at which the retainer is pivotally connected to the non-conductive material strip at a pivot point and rotatable alongside and substantially parallel with the non-conductive material strip between a holding position and a release position; and a fencing member engaging region, wherein in the holding position the fencing member engaging region extends across the slot at a point in substantially vertical alignment with pivot point, is adapted to retain a fencing member within the blind end of the slot and is positioned so as not to be placed under load by a fencing member should the fencing member be subjected to a substantially horizontal force in the direction of the outer longitudinal edge.

32. The fence post assembly of claim 31, wherein the at least one fencing member is selected from the group consisting of a plain wire, a barbed wire, a mesh panel, an insulator, a bracket and a rain gauge.

* * * * *